US007210429B2

(12) United States Patent
Johns

(10) Patent No.: US 7,210,429 B2
(45) Date of Patent: May 1, 2007

(54) ROTATING POSITIVE DISPLACEMENT ENGINE

(76) Inventor: Douglas Marshall Johns, P.O. Box 1670, Topanga, CA (US) 90290

( * ) Notice: Subject to any disclaimer, the term of this patent is extended or adjusted under 35 U.S.C. 154(b) by 24 days.

(21) Appl. No.: 10/338,526

(22) Filed: Jan. 8, 2003

(65) Prior Publication Data

US 2003/0131807 A1 Jul. 17, 2003

Related U.S. Application Data

(60) Provisional application No. 60/346,534, filed on Jan. 8, 2002.

(51) Int. Cl.
*F02B 57/00* (2006.01)

(52) U.S. Cl. ..... 123/43 A
(58) Field of Classification Search ..... 123/43 A, 123/43 AA, 51 B
See application file for complete search history.

(56) References Cited

U.S. PATENT DOCUMENTS

| | | | | |
|---|---|---|---|---|
| 225,651 | A | 3/1880 | Silver | |
| 848,665 | A | 4/1907 | Lombard | 123/43 A |
| 892,804 | A | 7/1908 | Burbank | 123/43 A |
| 893,181 | A | 7/1908 | Macomber | 123/43 A |
| 928,715 | A | 7/1909 | Thurber | 123/43 AA |
| 933,316 | A | 9/1909 | Macomber | 123/43 A |
| 968,969 | A | 8/1910 | Ord | 123/43 AA |
| 972,869 | A | 10/1910 | Jones | |
| 980,491 | A | 1/1911 | Coleman | 123/43 A |
| 1,019,521 | A | 3/1912 | Pratt | |
| 1,042,018 | A | 10/1912 | Macomber | |
| 1,116,768 | A | 11/1914 | Underwood | |
| 1,219,377 | A | 3/1917 | Davidson | |
| 1,255,664 | A | 2/1918 | Syger | |
| 1,275,494 | A | 8/1918 | Storle | 123/43 A |

(Continued)

FOREIGN PATENT DOCUMENTS

| | | | | |
|---|---|---|---|---|
| DE | 247383 | * 5/1912 | | 123/43 A |
| GB | 15490 | * 7/1913 | | 123/43 A |
| GB | 189246 | * 11/1922 | | 123/43 A |
| NO | 28632 | * 6/1919 | | 123/43 A |
| WO | WO 98/59160 | 12/1998 | | |

OTHER PUBLICATIONS

B. Tripolsky, "Bricklin Comes Back With A Rotary Engine", Mechanix Illustrated, pp. 50–51, Jan. 1977.

*Primary Examiner*—Thai-Ba Trieu
(74) *Attorney, Agent, or Firm*—Steven M. Koehler; Westman, Champlin & Kelly, P.A.

(57) ABSTRACT

An engine including a stationary housing; a cylinder bank rotatably mounted to the housing about a central longitudinal axis, the cylinder bank having a plurality of cylinders therein radially distanced from and parallel to the central longitudinal axis, each cylinder having a cylinder wall, an intake port, an exhaust port, a valve assembly governing the opening and closing of the intake port and the exhaust port, a piston moveable within the cylinder between an up position and a down position, and a connecting member having an inner end connected to the piston and an outer end; a torque plate operatively connected to the outer ends of the connecting members, the torque plate being rotatably mounted in a torque plane defined by the outer ends of the connecting members and which makes an oblique angle to a plane perpendicular to the central longitudinal axis, so that as the cylinder bank rotates the torque plate sequentially guides each piston from the up position to the down position during a first portion of a rotation of the cylinder bank and then sequentially guides each piston from the down position to the up position during a second portion of the rotation of the cylinder bank; and a synchronizing member operatively connected to the cylinder bank and the torque plate so that the cylinder bank and torque plate rotate at the same speed.

40 Claims, 11 Drawing Sheets

U.S. PATENT DOCUMENTS

| | | | | | |
|---|---|---|---|---|---|
| 1,277,964 | A | | 9/1918 | Lovelace | 123/43 A |
| 1,307,045 | A | | 6/1919 | Galbreath | |
| 1,332,756 | A | | 3/1920 | Root | |
| 1,345,808 | A | | 7/1920 | Reynolds | 123/43 A |
| 1,405,224 | A | | 1/1922 | Kenmonth | |
| 1,604,474 | A | | 10/1926 | Nisbet | |
| 1,696,676 | A | | 12/1928 | Fuhr | 123/43 A |
| 1,779,032 | A | | 10/1930 | Cathcart | |
| 1,825,691 | A | | 10/1931 | Hall | |
| 1,880,224 | A | | 10/1932 | Wilsey | 123/43 A |
| 1,895,206 | A | | 1/1933 | Ricardi | 123/51 B |
| 1,950,970 | A | * | 3/1934 | Chilton | 123/51 B |
| 1,961,905 | A | | 6/1934 | Michell | 123/51 B |
| 1,986,584 | A | | 1/1935 | Koplar | |
| 1,987,699 | A | | 1/1935 | Moore | |
| 2,080,846 | A | | 5/1937 | Alfaro | 123/51 B |
| 2,222,294 | A | | 11/1940 | Hall | 123/56.5 |
| 2,229,246 | A | | 1/1941 | Istad | 123/51 B |
| 2,276,772 | A | | 3/1942 | Heap | 123/43 AA |
| 2,329,480 | A | | 9/1943 | Neuland | |
| 2,337,543 | A | | 12/1943 | Christopher | |
| 2,342,900 | A | | 2/1944 | Sandell | 123/51 B |
| 2,354,620 | A | | 7/1944 | Smith | 123/51 B |
| 2,368,933 | A | | 2/1945 | Lindeman, Jr. | |
| 2,369,002 | A | * | 2/1945 | Wilson | 123/43 A |
| 2,382,280 | A | | 8/1945 | Allison | 123/43 A |
| 2,387,908 | A | | 10/1945 | Howard | |
| 2,406,292 | A | | 8/1946 | Hall | |
| 2,512,265 | A | | 6/1947 | Brigaudet | |
| 2,430,753 | A | | 11/1947 | Ziska | |
| 2,456,164 | A | | 12/1948 | Youhouse | 123/43 A |
| 2,513,083 | A | | 6/1950 | Eckert | |
| 2,556,585 | A | | 6/1951 | Jarvinen | |
| 2,776,649 | A | | 1/1957 | Fenske | 123/43 A |
| 3,007,462 | A | | 11/1961 | Balzer | |
| 3,528,394 | A | | 9/1970 | Cummins | |
| 3,654,906 | A | | 4/1972 | Airas | 123/43 A |
| 3,695,237 | A | * | 10/1972 | Londo | 123/43 A |
| 3,807,370 | A | | 4/1974 | Baugh | 123/43 C |
| 3,830,208 | A | | 8/1974 | Turner | 123/43 A |
| 3,902,468 | A | | 9/1975 | Turner | 123/43 A |
| 3,905,338 | A | | 9/1975 | Turner | 123/43 A |
| 3,939,809 | A | | 2/1976 | Rohs | 123/43 A |
| 3,945,359 | A | | 3/1976 | Asaga | |
| 3,968,776 | A | | 7/1976 | Rund | |
| 3,970,055 | A | | 7/1976 | Long | 123/43 A |
| 3,973,531 | A | | 8/1976 | Turner | 123/43 A |
| 4,060,060 | A | | 11/1977 | Turner | 123/43 A |
| 4,077,269 | A | | 3/1978 | Hodgkinson | |
| 4,144,771 | A | | 3/1979 | Kemper et al. | 74/60 |
| 4,149,498 | A | | 4/1979 | Ferrell | |
| 4,433,596 | A | | 2/1984 | Scalzo | |
| 4,620,475 | A | | 11/1986 | Watts | |
| 4,622,885 | A | | 11/1986 | Schriwer | |
| 4,624,175 | A | | 11/1986 | Wahlmark | |
| 4,648,358 | A | | 3/1987 | Sullivan et al. | |
| 4,779,579 | A | | 10/1988 | Sukava | 123/43 A |
| 4,960,082 | A | | 10/1990 | Sullivan et al. | 123/43 A |
| 5,070,825 | A | | 12/1991 | Morgan | 123/43 A |
| 5,103,778 | A | | 4/1992 | Usich, Jr. | 123/43 AA |
| 5,159,902 | A | | 11/1992 | Grimm | 123/43 A |
| 5,209,190 | A | | 5/1993 | Paul | |
| 5,215,045 | A | | 6/1993 | Vadnjal | |
| 5,323,738 | A | | 6/1994 | Morse | 123/43 AA |
| 5,601,055 | A | | 2/1997 | Haines | 123/43 A |
| 5,904,044 | A | | 5/1999 | White | 123/48 C |
| 839,300 | A1 | | 12/2006 | Krohn | |

* cited by examiner

ROTATING POSITIVE DISPLACEMENT ENGINE

CROSS-REFERENCE TO PRIORITY APPLICATION

The present application is based on and claims the benefit of U.S. provisional patent application Serial No. 60/346,534, filed Jan. 8, 2002, the content of which is hereby incorporated by reference in its entirety.

BACKGROUND OF THE INVENTION

The present invention relates to engines of all sorts. More particularly, the present invention relates to an engine having a rotating cylinder bank.

Internal combustion engines have been around for a long time and include, primarily, the Otto-type and Wankel engines. The Otto-type engine is a four-cycle engine in which a piston linearly reciprocates within a cylinder combustion chamber. The cylinders are typically arranged in one of three ways: a single row (in line) with the centerlines of the cylinders vertically oriented; a double row with the centerlines of opposite cylinders converging in a V (V-engine); or two horizontal, opposed rows (opposed or pancake engine). Beginning in the early part of the twentieth century, the conventional Otto-type reciprocating engine began to assume dominance as the most practical approach, even though it was recognized that a large portion of the energy developed through combustion of fuel was wasted in decelerating and accelerating the pistons on their reciprocating strokes. The Wankel engine, which is also known as a rotary engine, is denoted as such because it utilizes a triangular rotating disc which forms combustion chambers as it rotates within a fixed cylinder. The Wankel engine is also a four-cycle engine, and while it has several advantages over the Otto-type engine, it lacks torque at low speeds which leads to greater fuel consumption.

It is desirable that a practical internal combustion engine have one or more, and preferably all, of the following advantageous features not heretofore provided: (1) a smooth, relatively vibration-free engine; (2) no energy lost in accelerating and decelerating reciprocatingly moving pistons; (3) multiple power take-off points; (4) a plurality of ignition systems optional; (5) an option of employing conventional supercharger and fuel injector-spark plug ignition or compression ignition of air and fuel injection analogous to a diesel engine; (6) improved central fuel/air injection in which the fuel/air is moved outwardly through the engine by centrifugal force to afford a more nearly uniform combustion mixture and complete exhaust through a peripherally disposed discharge port; (7) an unusual high-power-to-weight ratio; (8) a mechanical efficiency curve that becomes more advantageous to doing meaningful work earlier in the power stroke, than in the conventional Otto-type engine, in order to take advantage of the higher cylinder pressures at that time which results in increased torque and more power; (9) an ability to change the cubic displacement and therefore the torque potential of the engine while it is running thereby giving it the ability to respond to varying power needs; (10) an ability to take advantage of a four-cycle progression which includes intake, compression, ignition-power, and exhaust, in a rotary configuration; and (11) the option of altering the mechanical efficiency curve to virtually any configuration.

In the early 1970's a two-cycle rotary vee engine was invented as illustrated in U.S. Pat. Nos. 3,830,208; 3,902,468; and 3,905,338. In essence, the rotary vee included six cylinders in each end of a housing, the middle of which was bent at a vee angle of 110°. The pistons in each cylinder at one end of the housing were fixedly attached to the respective piston in the opposite end of the housing, and the entire cylinder-piston arrangement revolved. The advantages of the rotating cylinder banks of the vee engine were in the substantial increased power and efficiency when compared to a linearly reciprocating Otto-type engine or Wankel engine. However, the design structure of the vee engine failed because the torque developed by the second cylinder bank was transmitted through the first via a violent twisting motion which scored the pistons and cylinder walls whenever a large load was applied. The other problem with the vee engine was that it was a two-cycle oil-in-fuel mixture design which is less reliable and less clean burning than a four-cycle configuration.

It is therefore desirable to provide a new rotary engine with a rotating cylinder bank like the vee engine, but with improved fuel efficiency, lower emissions, smaller size, and/or greater power and which has the advantageous features mentioned above.

SUMMARY OF THE INVENTION

The present invention relates to an engine including a stationary housing; a cylinder bank rotatably mounted to the housing about a central longitudinal axis, the cylinder bank having a plurality of cylinders therein radially distanced from and parallel to the central longitudinal axis, each cylinder having a cylinder wall, an intake port, an exhaust port, a valve assembly governing the opening and closing of the intake port and the exhaust port, a piston moveable within the cylinder between an up position and a down position, and a connecting member having an inner end connected to the piston and an outer end; a torque plate operatively connected to the outer ends of the connecting members, the torque plate being rotatably mounted in a torque plane defined by the outer ends of the connecting members and which makes an oblique angle to a plane perpendicular to the central longitudinal axis, so that as the cylinder bank rotates the torque plate sequentially guides each piston from the up position to the down position during a first portion of a rotation of the cylinder bank and then sequentially guides each piston from the down position to the up position during a second portion of the rotation of the cylinder bank; and a synchronizing member operatively connected to the cylinder bank and the torque plate so that the cylinder bank and torque plate rotate at the same speed.

The engine according to the present invention is adaptable to a four-cycle internal combustion engine having an exhaust stroke, an intake stroke, a compression stroke, and a power stroke. In this case, the engine further comprises valve control means for sequentially opening the intake port of every other cylinder for a first rotation of the cylinder bank for the exhaust stroke during which combusted gases are exhausted from every other cylinder as the respective piston therein moves from the down position to the up position and then for the intake stroke during which the combustible fuel is supplied to every other cylinder as each respective piston therein moves from the up position to the down position, and the valve control means then sequentially closing the valve of every other cylinder for a second rotation of the cylinder bank for the compression stroke during which the combustible fuel in every other cylinder is compressed as the respective piston therein moves from the down position to the up position and then for the power stroke during which the ignition means sequentially ignites the combustible fuel in every other cylinder forcing the respective piston therein from the up position to the down position, wherein the four-cycle operation is completed for each cylinder after two full rotation of the cylinder bank.

DETAILED DESCRIPTION OF THE PREFERRED EMBODIMENTS

Figure 1:
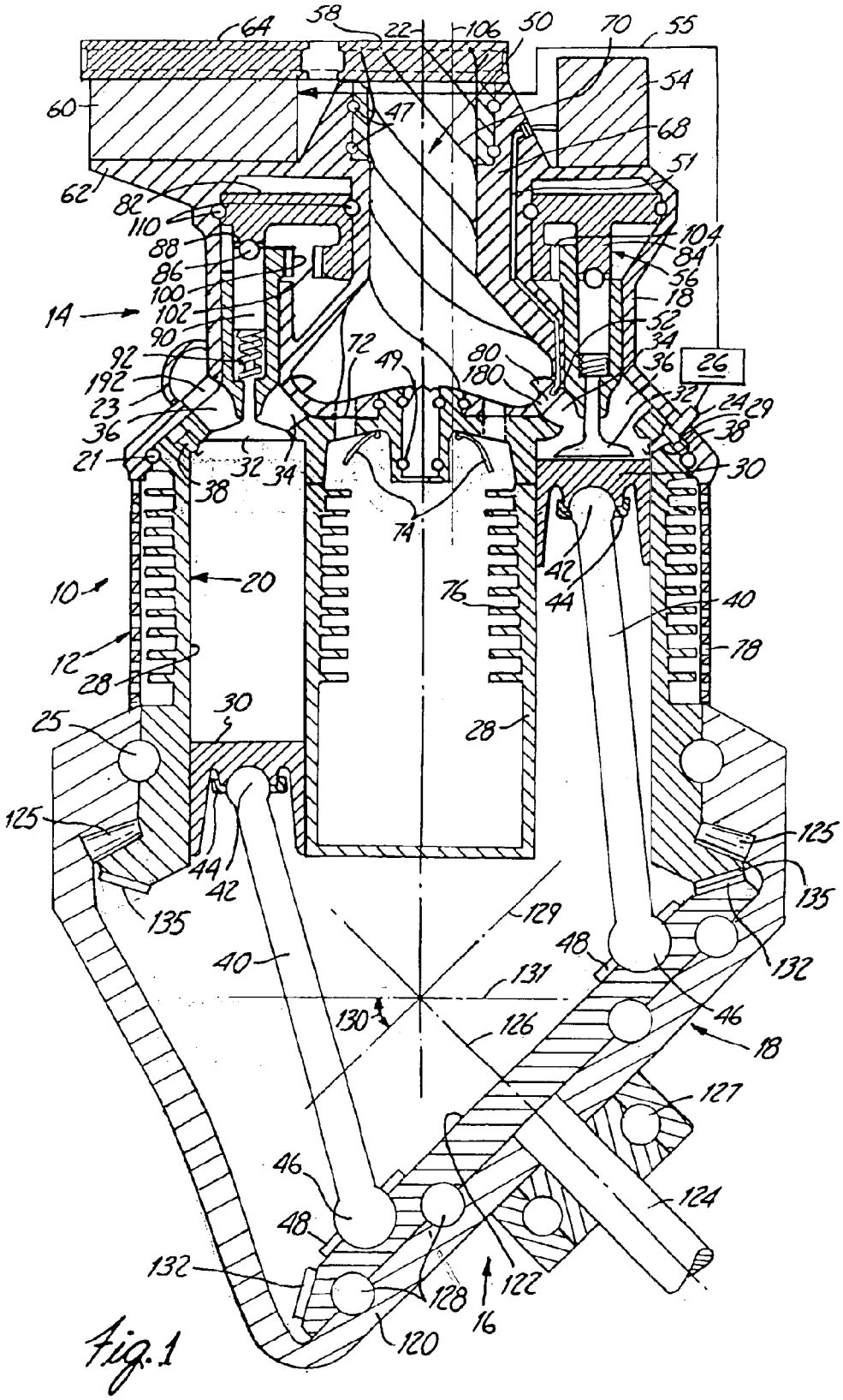
FIG. 1 is a longitudinal cross sectional along Line I—I of FIG. 2B showing a four-cycle rotating positive displacement engine according to the teachings of the present invention.

FIG. 1 illustrates a rotating four-cycle positive displacement internal combustion engine 10 according to the principals of the present invention. The engine 10 includes a power production assembly 12, a fuel control assembly 14, and a power take-off assembly 16. Four-cycle operation is provided in the course of two complete revolutions of the engine, wherein there is an intake cycle ranging from about 0° to about 180° of the first revolution of the engine, a compression cycle ranging from about 180° to about 360° of the first revolution, a power cycle ranging from about 360° to about 540° of the second revolution, and an exhaust cycle ranging from about 540° to about 720° of the second revolution, as will be further explained below in the section entitled Operation of the Invention.

The power production assembly 12 includes a stationary housing 18, a cylinder bank 20 rotatably mounted within the stationary housing 18 about a central longitudinal axis 22 via bearings 21 and 25, an exhaust manifold 23 fixedly attached to the stationary housing 18, a spark plug commutator 24 mounted to the stationary housing 18 so as to operate in contact with the rotating cylinder bank 20, and a control unit 26 for providing the desired ignition sequence. The cylinder bank 20 includes a plurality of equidistantly-spaced and radially-offset combustion chambers therein, each of which is formed by a cylinder 28, a piston 30, and a valve 32, and each of which further includes an intake port 34, an exhaust port 36, and a spark plug 38. The fuel control assembly 14 admits a fuel and air mixture in a timed sequence into each cylinder 28 via its intake port 34 as the piston 30 therein moves from an up position to a down position as the cylinder bank 20 rotates. The fuel/air mixture is compressed within the cylinder 28 as the piston 30 therein moves from the down position to the up position as the cylinder bank 20 rotates, and then the control unit 26 explodes the fuel/air mixtures in timed sequence as the spark plug 38 in each cylinder 28 operatively engages the spark plug commutator 24 at location 29 as the cylinder bank 20 rotates. Commutator as used herein includes any form of mechanical or electronic timing of initiating spark. The explosion drives the respective piston 30 from the up position to the down position and causes the cylinder bank 20 to rotate thereby capturing the expanding gases from the exploded fuel and transferring the energy to torque. The combusted gases within the cylinder 28 are exhausted through the exhaust port 36 thereof and into the exhaust manifold 23 as the piston 30 moves from the down position to the up position as the cylinder bank 20 rotates.

Each piston 30 is connected to a rod 40 which transfers the torque to the power take off assembly 16. Each rod 40 has an inner end 42 spherically mounted to an underside of the respective piston 30 using a retaining ring 44 so that the inner end 42 of the rod 40 freely rotates and pivots about its own axis as the cylinder bank 20 rotates. Each rod 40 has an outer end 44 coupled (e.g. spherically, universal joint, etc.) mounted to power take off assembly 16 using a retaining ring 48 so that the outer end 46 of the rod 40 freely rotates and pivots about its own axis as the cylinder bank 20 rotates.

In order to achieve the four-cycle operation, it is preferred that there is an odd number (1, 3, 5, 7, 9, etc.) of combustion chambers so that as the cylinder bank 20 rotates, each cylinder 28 goes through the four-cycle operation in a simple timed sequence wherein every other cylinder 28 is acted upon. More specifically, on one side of the engine adjacent cylinders 28 alternate between the intake and power cycles, wherein the control unit 26 times the spark plugs 38 so as to fire in every other cylinder 28 as the cylinder bank 20 rotates, and wherein the fuel control assembly 14 admits a fuel and air mixture to every other cylinder 28 as the cylinder bank 20 rotates. On the other side of the engine, the adjacent cylinders 28 alternate between the compression and exhaust cycles. In the seven cylinder 28 engine illustrated in FIG. 2, this alternate firing/fueling and, conversely, compression/exhaust provides continuous operation and accomplishes the four-cycle operation for all of the cylinders 28 in the course of two full rotations of the cylinder bank 20 in the following sequence: Cylinder #1, #3, #5, #7, #2, #4, #6, #1, etc., as will be further explained below in the section entitled Operation of the Invention.

The valves 32 seal the cylinder 28 from the intake port 34 and the exhaust port 36 and are built to withstand the full pressure of the exploding gasses within the combustion chamber. The valves 32 are typically poppet valves as are used in standard contemporary gasoline engines. This single valve 32 configuration is preferred over separate intake and exhaust valves because it achieves greater volumetric efficiency, simplifies the cam geometry, enables less energy to be spent depressing the valve 32 only once during each four cycle operation, and reduces the need for rapid acceleration of the valve stroke as is necessary in a two valve configuration. Nevertheless, it should be noted one or more intake and one or more exhaust valves can be used in other embodiments of the invention.

Figure 2A:
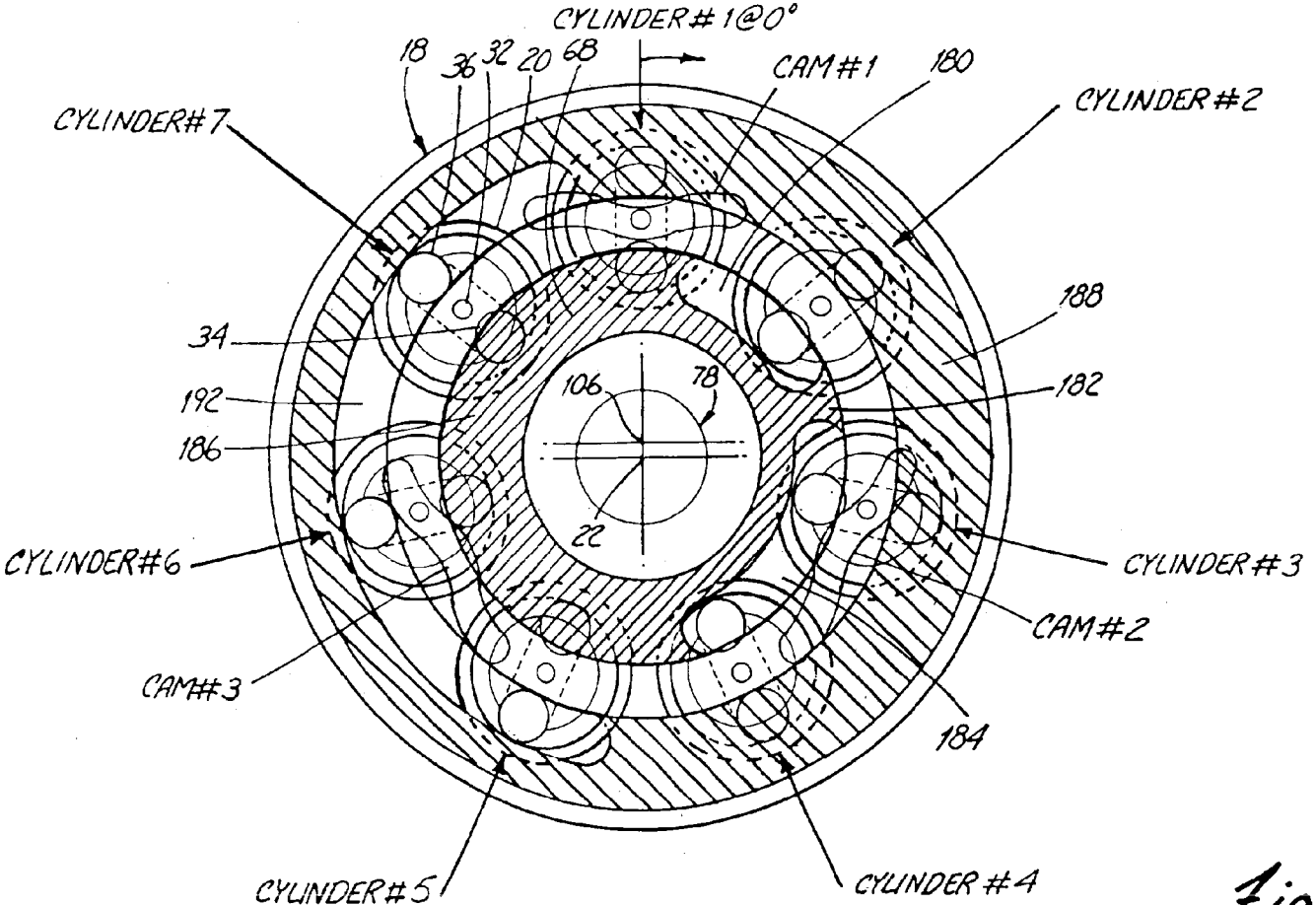
FIGS. 2A–2G are a series of horizontal cross sections of the engine shown in FIG. 1 at selected positions of a rotational cycle, with the cam surfaces superimposed over the cylinders according to the teachings of the present invention.

Referring to FIGS. 1 and 2A, in the embodiment illustrated, the fuel control assembly 14 includes a rotating air supply turbine 50 or other air compressor unit for admitting and pressurizing ambient air into the engine 10, a plurality of fuel lines 51 having liquid fuel injectors 52 connected thereto for mixing and admitting atomized liquid fuel and the pressurized ambient air that is entering the cylinders 28, a fuel supply unit 54, and the control unit 26 for regulating the flow of fuel from the fuel supply 54 to the fuel injectors 52 and for regulating the speed of the turbine 50 and the pressure and volume of air flowing into the cylinders 28, and a cam assembly 56 for regulating the valves 32 of each cylinder 28 in relation to the turbine 50, the fuel injectors 52, and the exhaust manifold 23. Ambient air enters the engine 10 at the center of rotation through an air intake port 58 and is compressed by the turbine 50, which spins at a substantially greater rate than the cylinder bank 20. The turbine 50 is rotatably mounted via bearings 47 and 49 and driven by any one of a variety of methods including a gear train directly linked to the rotating cylinder bank 20. Preferably, the turbine 50 is driven by a variable speed motor 60, mounted on a support 62, which transfers power either directly or through a power train 64. The speed of the motor 60 is variable and governed by control unit 26 via line 55 so as to control the pressure and volume of air provided to the engine 10 in proportion to the needs of varying operating engine conditions such as load, rpm, temperature, etc. The engine conditions are monitored through the use of dedicated real time sensors, which are well known in the art, for measuring conditions such as rpm, load, throttle position, head temperature, air velocity, exhaust composition, and manual override, etc.

Air in the turbine 50 flows axially and radiates downwards from the air intake port 58 and towards the circumference of a stationary turbine shroud 68 by action of turbine impellers 70 and thereby becomes pressurized for entering the rotating cylinder bank 20. This pressurized air can serve two purposes. First, the pressurized air enters the plurality of cooling ports 72 to cool the interior of the cylinder bank 20. A bimetallic valve 74, or similar acting device, at the entrance to cooling port 72 automatically opens and closes to increase or decrease the heat dissipation, thereby keeping the engine 10 at a uniform operating temperature. The cylinder bank 20 has cooling fins 76 protruding therefrom to help increase the efficiency in transferring cooling air to and heat away from the interior of the engine 10. The pressurized air from the turbine 50, augmented by the spinning, turbine-like motion of the cylinder bank 20 and the cooling fins 76, exits the cylinder bank 20 via a plurality of cooling slots 78 on the exterior stationary housing 18. The cooling slots 78 should be irregularly spaced so as to avoid harmonic whistling. The second function of the pressurized air from the turbine 50 is to provide pressurized air for combustion in the cylinder chambers. In this case the pressurized air passing through the turbine 50 then passes butterfly valve 80 and through intake port 34, where it mixes with the fuel, and then into the cylinder 28. Fuel is added to the cylinder 28 via the series of fuel lines 51, which pass longitudinally through a portion of the stationary turbine shroud 68 and then to fuel injectors 52, which can be in the intake manifold or associated with the cylinder. The control unit 54 supplies and controls the flow of liquid fuel through the fuel injectors 52 to the stream of pressurized air passing through the intake port 34, depending on engine conditions.

Figure 2B:
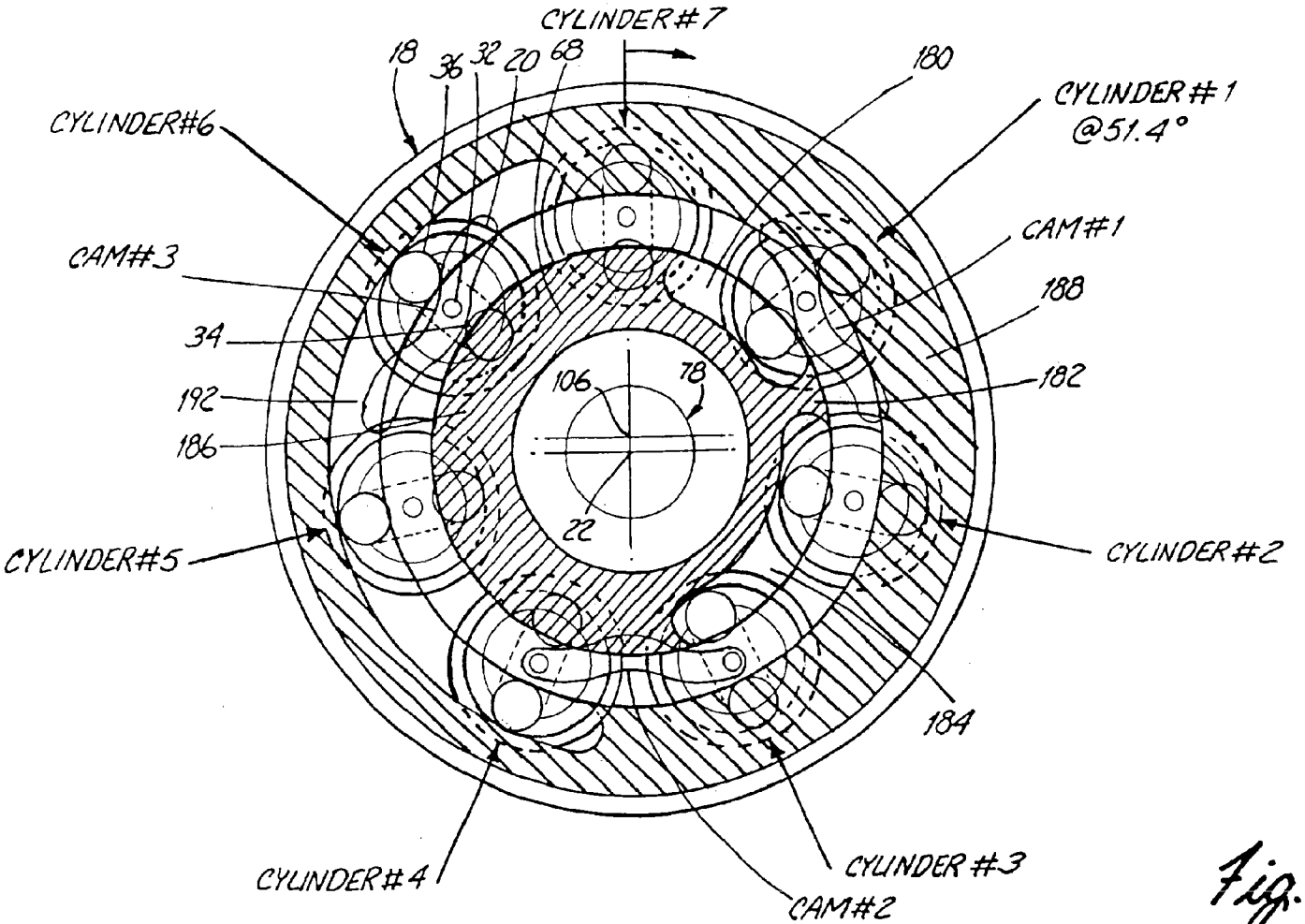
Figure 2C:
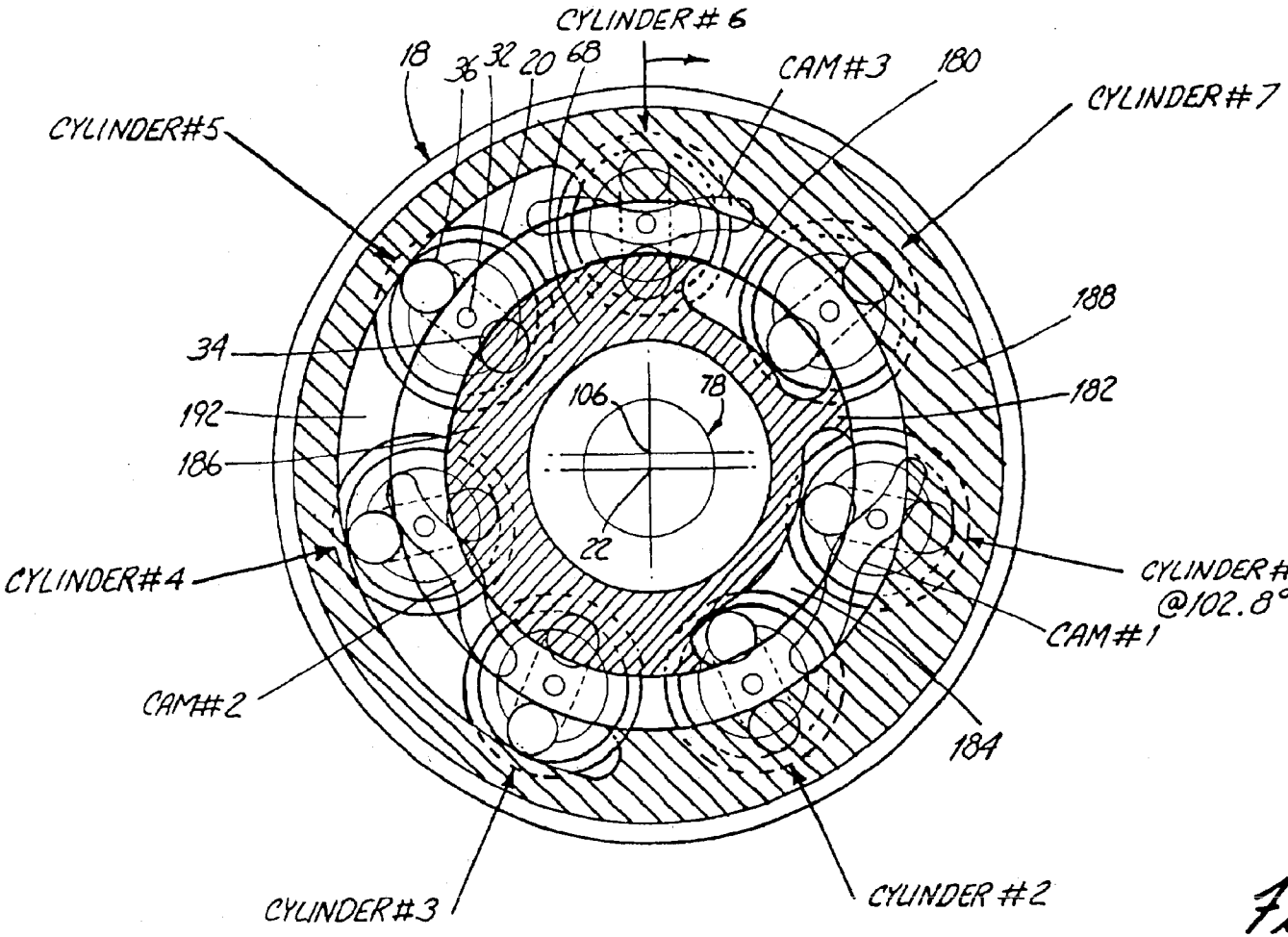
Figure 2D:
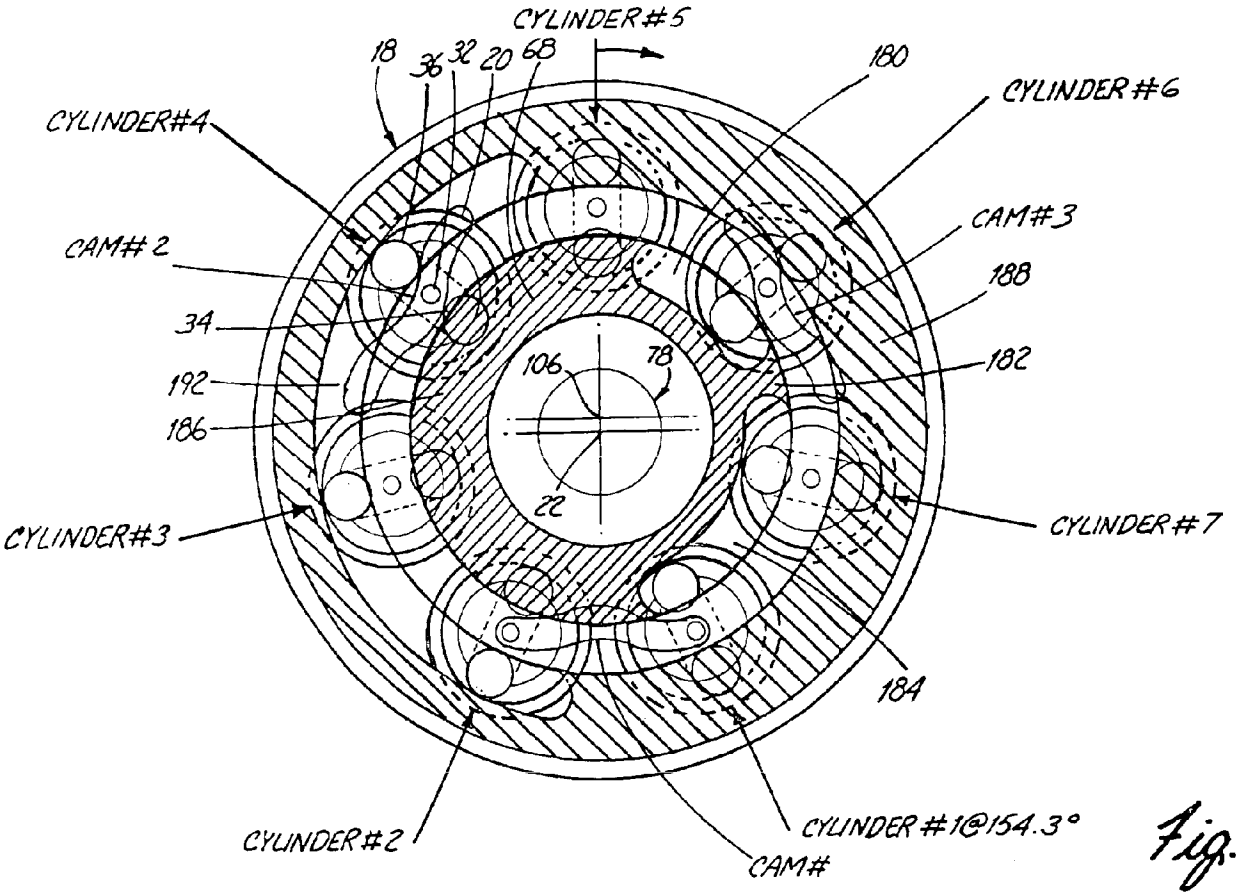
Figure 2E:
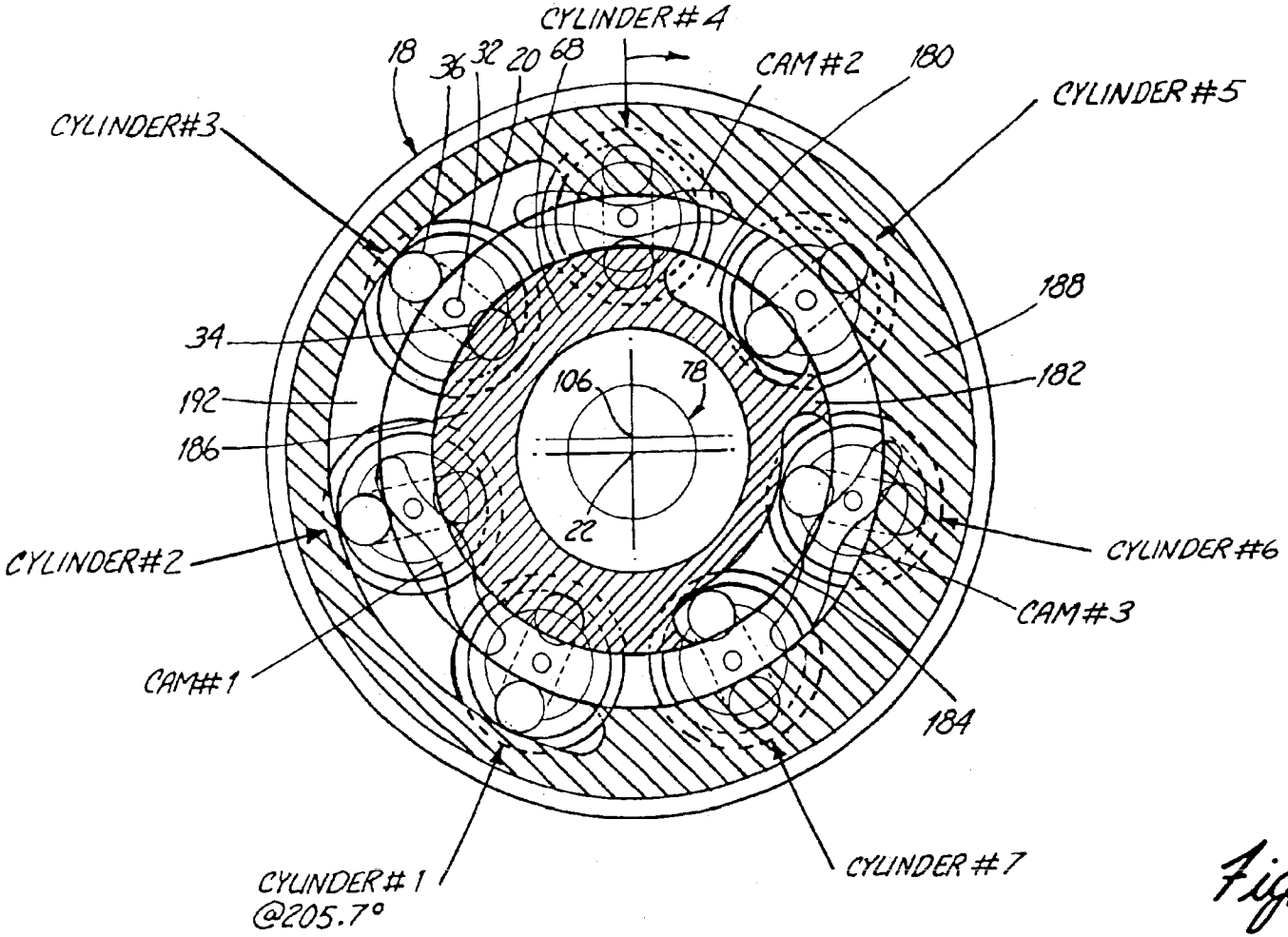
Figure 2F:
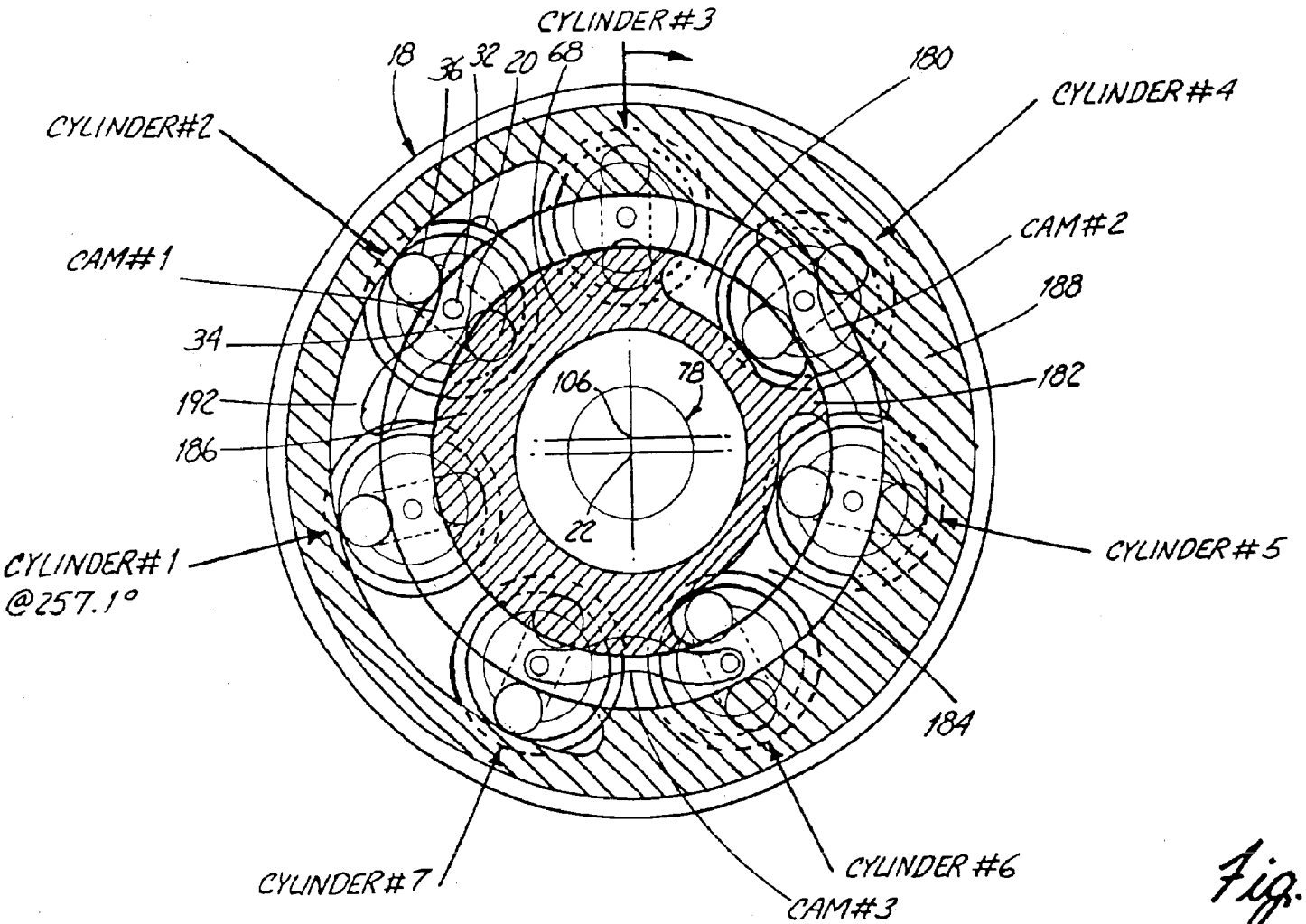
Figure 2G:
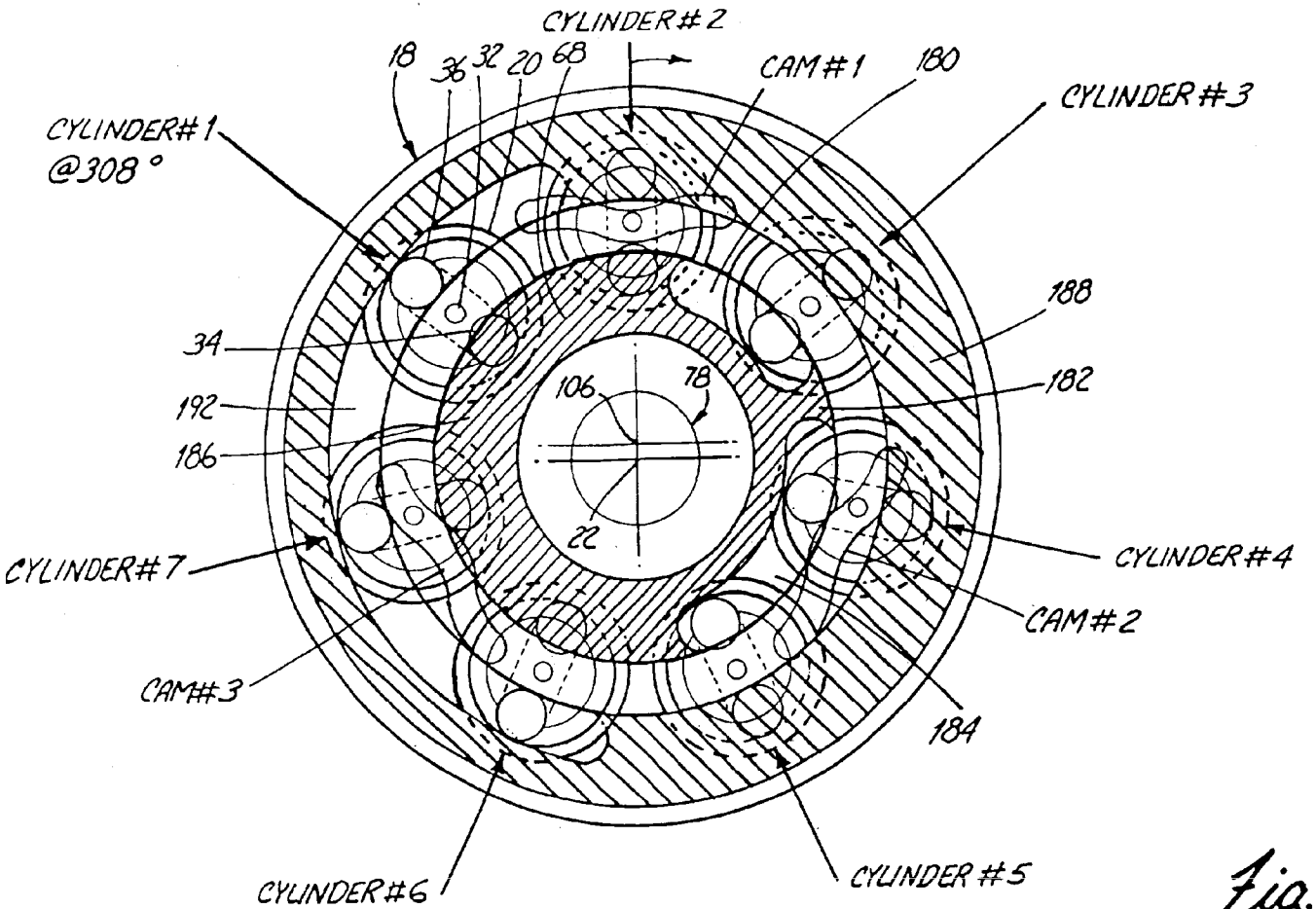
Figure 3:
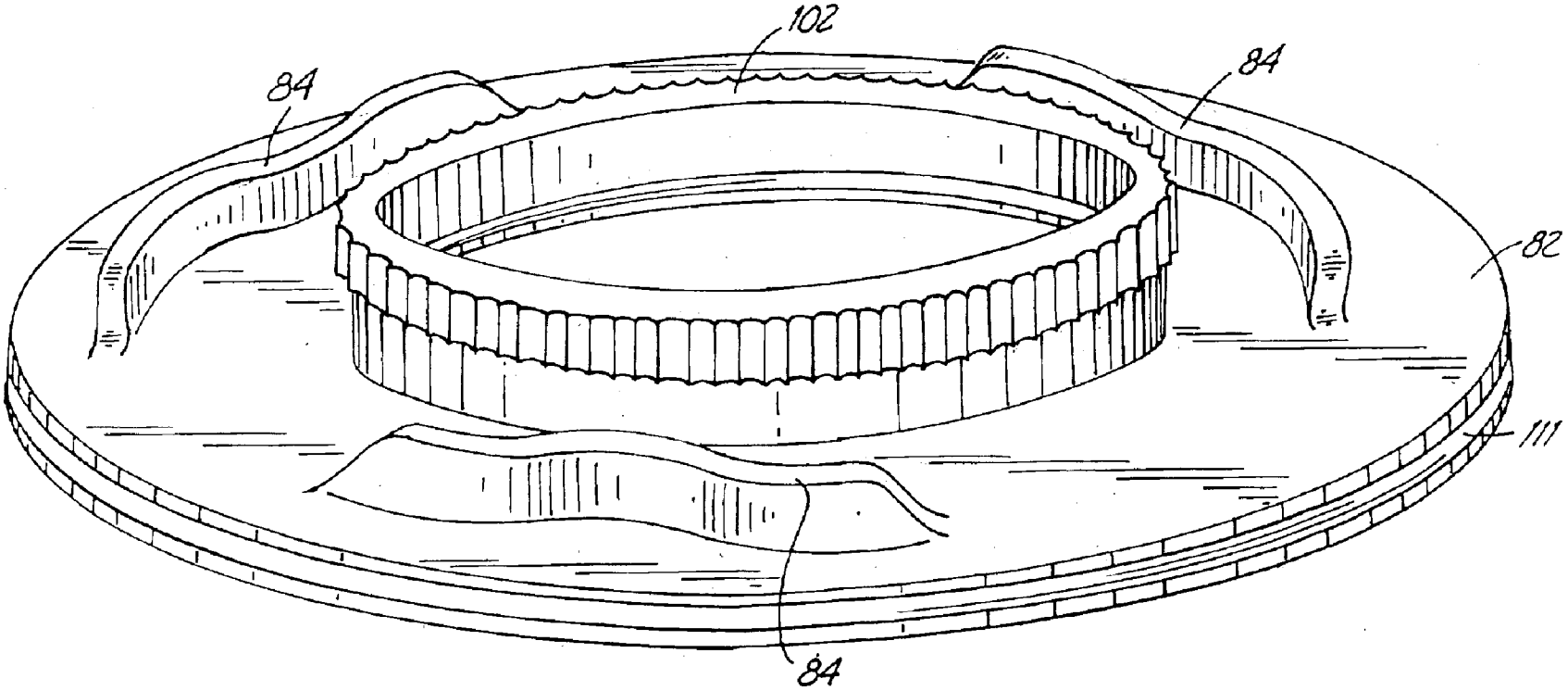
FIG. 3 is a perspective view of a cam plate for activating the cylinder valves in accordance with the teachings of the present invention.

Referring to FIGS. 1 and 3, the cam assembly 56 includes a cam plate 82 having a plurality of cam surfaces 84 protruding therefrom or other mechanical actuator, and a tracking ball 86, retaining ring 88, valve lifter 90, and valve return spring 92 associated with each cylinder valve 32. The cam assembly 56 times the valves 32 so as to open commencing at the exhaust cycle (540° to 720°) and remaining open through the intake cycle (0° to 180°). It is preferred to use an odd number of pistons 30 and corresponding cylinders 28 so that every other piston 30 continuously fires while the cylinder bank 20 is rotating in normal operation. If an even number of pistons 30 and corresponding cylinders were to be used it would substantially complicate the timing of valves 32 and they would have to include electronically controlled actuators. Nevertheless, electronically controlled actuators can be used in place of the cam plate, if desired. In an embodiment comprising a cam plate, cam plate 82 has an external gear 100 that engages an internal gear 102 on the cylinder bank 20, or any other similar positive method of interaction, at position 104. The cam plate 82 spins at an exact synchronous ratio to the cylinder bank 20 so that the cam surfaces 84 are timed to actuate the valves 32 according to the particular timing sequence of the engine. In the illustrated example of a seven-cylinder engine, the cam plate 82 advances seven rotations for every six rotations of the cylinder bank 20. The three cam surfaces 84 on the cam plate 82 are squiggle in shape and of uniform height, as shown in FIG. 3, so that with the seven-to-six gear ratio of the cam plate 82 to cylinder bank 20 the cam surfaces 84 contact and stay in contact with every other roller tracking ball 86 as the cylinder bank 20 rotates (see FIGS. 2A–2G). Depression of the roller ball 86 by the cam surfaces 84 thereby actuates the valve 32, herein through the respective valve lifter 90, and corresponding valve 32 as the engine rotates, so that each valve 32 is depressed only one time in every two rotations (720°) of the cylinder bank 20. The valve return spring 92 returns the valve 32 to the closed position after the cam surfaces 84 move past the tracking ball 86.

Referring again to FIGS. 1 and 3, the cam plate 82 is rotatably mounted to the stationary housing 18 about a cam axis 106 using a suitable bearing assembly, herein exemplified as ball bearings 110 which ride in a bearing race 111. The cam axis 106 is essentially parallel to the central longitudinal axis 22 and radially offset outwardly from it in the direction of top dead center. This offset is to be determined by the difference in the radius of the gears 100 and 102 on the spinning cam plate 82 and the rotating cylinder bank 20, respectively. The six-to-seven gear ratio causes each valve 32 to be opened only for the desired fuel exhaust and intake cycles of the engine 10, and to remain closed for the compression and power cycles of the engine 10. For other design embodiments involving a different odd number of cylinders 28 (for example 1, 3, 5, 9, 11, etc.) and a different number of valves 32 per cylinder (for example 1, 2, 3, 4, etc.) there will be a different timing ratio and a different number of cam surfaces 84 on the cam plate 82. For example in a five cylinder engine (not shown) having one valve per cylinder, the cam plate 82 would spin slower than the cylinder bank 20 at a ratio of ⅚ its speed and there would be three cam surfaces 84.

As shown in FIG. 1, in its simplest form the power take off assembly 16 includes a load bearing torque plate 120, a spinning thrust plate 122, and a power take off shaft 124. The thrust plate 122 revolves in a plane 129 around a torque axis 126 and is supported by the torque plate 120 by bearings 128 which contain the thrust plate 122 both laterally and longitudinally. Tapered roller bearings 125 absorb stresses between the rotating cylinder bank 20, the thrust plate 122 and the stationary housing 18. The torque plate 120 is tilted at a fixed oblique angle 130 to a plane 131 which is perpendicular to the central longitudinal axis 22, which is between 0° and 90° degrees. At the perimeter of the thrust plate 122 is a gear 132 or other synchronizing mechanism, which interfaces with a gear 135 at the perimeter of the cylinder bank 20 and synchronizes the two in a one-to-one rotational relationship at the fixed oblique angle 130. The power take off shaft 124 is fixed to the spinning thrust plate 122 and rotatably mounted to the thrust plate 122 via bearings 127. The thrust plate 122 supports the outer ends 46 of all the connecting rods 40, which are spherically, rotatably mounted thereto via retaining rings 48. The thrust plate 122 directs the connecting rods 40 on a circular course in unison with the pistons 30 as the cylinder bank 20 rotates. Since the torque plate 120 is at an oblique angle 130 to the central longitudinal axis 22 and since the pistons 30 are linked to the thrust plate 122 and thereby to the torque plate 120, by the connecting rods 40, the pistons 30 are forced to reciprocate between an up position at top dead center (0°) and a down position at bottom dead center (180°) as they rotate with the cylinder bank 20 about the central longitudinal axis 22. As is evident from FIGS. 1 and 2, increasing the oblique angle 130 which the torque plate 120 makes with the plane 131 perpendicular to the central longitudinal axis 22 would cause the cubic displacement in the combustion chamber of the cylinder 28 to increase to a maximum defined by the stroke, which is the distance that the piston travels within the cylinder 28 as the rotation of the cylinder bank 20 advances from top dead center (0°) to bottom dead center (180°) multiplied by the radius of the circular trajectory of the centers of the outer ends 46 of the connecting rods 40 as they travel about torque axis 126. It is envisioned that a spherical-faced miter gear (not shown)can be used in place of perimeter gear 132 on both the torque plate 120 and cylinder bank 20 to enable the oblique angle 130 between the torque plate 120 and cylinder bank 20 to be adjusted in a range between 0° and 90°. The embodiment shown in FIG. 5 illustrates, as explained below, another way to vary this oblique angle 130 and thereby the torque potential of the engine 10.

Since the pistons 30 are linked to the torque plate 120 by connecting rods 40 they are thus made to follow said trajectory thereby forming an oval trajectory with the long axis of the oval at an oblique angle to the central longitudinal axis 22. This oval trajectory of the pistons 30 is important because as the cylinder bank 20 rotates, the pistons 30 and connecting rods 40 travel in sequence along a longer path than the circular path of the cylinder bank 20, thereby in effect increasing the mechanical efficiency of the pistons 30 to the torque plate 120.

Figure 4:
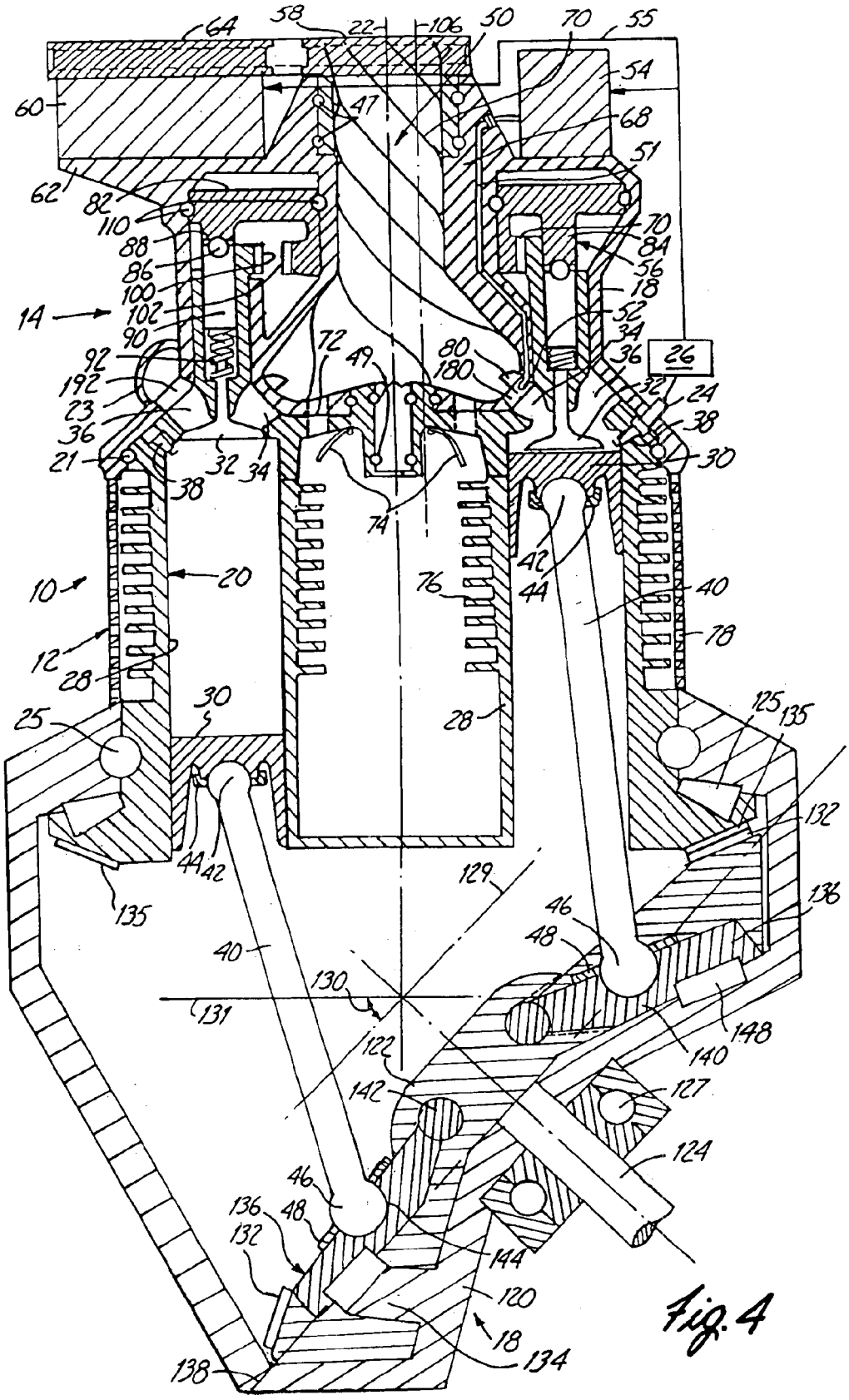
FIG. 4 is a longitudinal cross section of another embodiment of the four-cycle positive displacement engine according to the teachings of the present invention.

Referring to FIG. 4, it can be helpful to modify the otherwise planar circular course that the bottoms 46 of the connecting rods 40 would follow on the torque plate 120 in order to advance the mechanical advantage curve of the engine. Properly configured, the course which the connecting rods 40 follow allows the attached piston-rod assembly to have an optimum mechanical advantage earlier in the power stroke in order to take advantage of the higher pressures that are available during the initial phase of the power stroke. In this embodiment, the torque plate 120 includes an undulating cam surface 134 and the spinning thrust plate 122 includes a pivoting arm cam roller mechanism 136. The undulating cam surface 134 will, starting sharply at approximately 0° of rotation, dip below the normally planar rotation of imaginary plane 138, thereby increasing the angle of attack of outer ends 46 of the rods 40 to the imaginary plane 138. The cam surface 134 will gradually, starting at approximately 15° of rotation, rise to meet the imaginary plane trajectory 138 at approximately 90° of rotation. This cam surface 134 can vary at other points around the rotational trajectory as desired. The pivoting arm cam roller mechanism 136 includes a pivot arm 140 that articulates from pivot 142, a semi-spherical seat 144 in an upper section of the pivot arm 140 for engaging the outer end 46 of the connecting rod 40, and a cam roller 148 rotatably mounted to a lower section of the pivot arm 140 for engaging the undulating cam surface 134 along the now undulating circular course. As the cylinder bank 20 rotates, the cam roller 148, the respective pivot arm 140, and thereby the connecting rod 40 and piston 30 all track in unison along cam surface 134. When cam surface 134 dips below the imaginary circular trajectory, the mechanical advantage at the moment of change is amplified according to the pitch of the tangent, in relation to the torque axis of the center rotation 126. The moment of change of piston 30 reflects the mechanical advantage of the whole system. In other words, the undulating cam surface 134 allows the piston 30 movement to be increased at the initial part of the rotational cycle, thereby capturing more of the expanding force from the fuel explosion power cycle and directing it to rotational energy rather than having the body of the engine 10 absorb the energy as excess heat or waste. Thus, the engine 10 runs cooler and has significantly higher torque.

Figure 5:
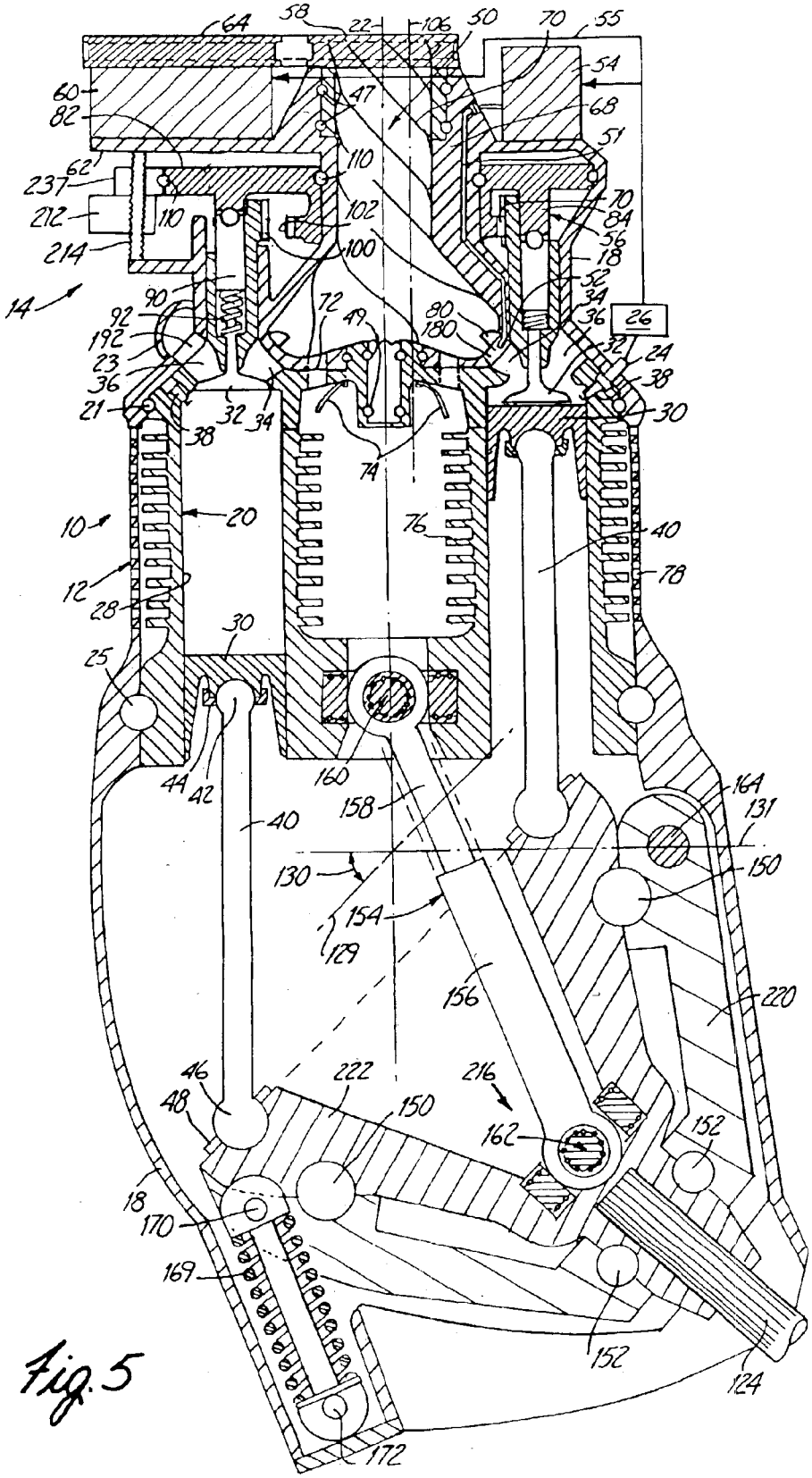
FIG. 5 is a longitudinal cross section of another embodiment of the four-cycle positive displacement engine according to the teachings of the present invention.

FIG. 5 illustrates a more versatile embodiment of the invention since it provides for a variable torque power take off assembly 216. The variable torque power take off assembly 216 includes a cup-shaped load-bearing rotating thrust plate 222 which is nested adjacent a cup-shaped torque plate 220, and which is supported by bearings 150 and 152. The angle of the torque plate 220 and therefore the stroke can be adjusted using a variety of methods. One method utilizes a torque load bearing spring 169 which is set beneath torque plate 220 and attached at one end to the torque plate 220 at pivot 170 and at the other end to the stationary housing 18 at pivot 172. The spring 169 is calibrated to compress with increasing pressure placed upon it. As the spring 169 compresses, the oblique torque plate angle 130 decreases in relation to the central longitudinal axis 22, thereby increasing the displacement within the cylinders 28 and effectively enlarging the engine so as to respond to an increased demand made upon it. The cylinder bank 20 and thrust plate 222 are synchronized to rotate at the same speed by the action of a synchronizing member 154 which may include an internally-splined connecting shaft 156 coupled to an externally splined shaft 158. An upper end of the externally splined shaft 158 is connected to the cylinder bank 20 by a universal joint 160, while a lower end of the internally-splined shaft 156 is connected to the thrust plate 222 by a universal joint 162.

The variable torque power take-off assembly 216 may be tilted about pivot axis 164 while rotating in step with the cylinder bank 20 at any stage of the operation of the engine in order to change the length/displacement of the piston stroke, the compression ratio, and the advancement, retardation or alteration of the mechanical advantage curve. The torque plate 220 freely pivots at an oblique torque plate angle 130 around pivot axis 164, which is essentially perpendicular to the central longitudinal axis of rotation 22 and radially located at a distance from the central longitudinal axis 22 so as to keep the compression ratio fixed or at a desirable change ratio. The oblique torque plate angle 130 is most useful from 0° in relation to the central longitudinal axis 22, which allows the cylinder bank 20 to be free spinning, to about 90° for maximum torque potential. The larger the oblique torque plate angle 130, the more torque the engine 10 develops and the more stress there is on the structure of the universal joints 160 and 162. The pivot axis 164 may be, if desired, varied in location from 90° to the central longitudinal axis 22 or to any other angle and any distance from the central longitudinal axis 22 in order to optimize performance. The tilting of the variable torque power take-off assembly 216 causes the synchronizing member 154 to lengthen or shorten, as externally splined shaft 158 slides, respectively, out of or into the internally splined shaft 156. The power output shaft 124 is fixed to the spinning thrust plate 222 for rotation therewith and for delivering the output torque of the engine 10. The oblique torque plate angle 130 is ultimately controlled by the control unit 54 which regulates both the fuel and air and/or expansion products. When a throttle (not shown) is activated, the control unit 26 causes the expansion products to increase in pressure and volume and therefore enlarge the combustion or buckling pressure between the cylinder bank 20 and the torque plate 220. This increased pressure compresses the spring 169 which increases the torque plate angle 130 and the cubic displacement in the cylinders 28, and therefore increases the torque of the entire system.

It should now be apparent that the torque plate angle 130 may be varied by other more controlled means such as mechanical actuators (not shown) like stepper motors, hydraulic pistons, magnetic actuators or manual controls. These systems can be operatively linked to the control unit 26 and made to operate in real time by monitoring and reacting to the physical conditions within the engine such as RPM, torque load, accelerator position, cylinder temperature, intake pressure, torque plate angle, turbine RPM, etc.

It should also be noted that in the illustrated case of a variable torque power take off assembly 216 as shown in FIG. 5, it is desirable to vary the stoke of the valve 32 in relation to the oblique angle 130 of the torque plate 220. The cam plate 82 is rotatably mounted to support 237 which is attached to an indexing servo motor 212 which moves up or down on a threaded rod 214 to drive support 237 either up to decrease the stroke of valve 32 when the stroke of the piston 30 is decreased or down to increase the stroke of valve 32 when the stroke of piston 30 is increased. The purpose of changing the stroke (i.e. amplitude) of valve 32 is to provide for increased volumetric capability within the combustion chamber when the stroke of piston 30 is increased. On the other hand, as the stroke of the piston 30 is deceased the stroke of valve 32 must be decreased to provide clearance between the valve 32 and the piston 30 as they pass in near proximity at the position of top dead center of rotation which occurs between the exhaust cycle and intake cycle and between the compression cycle and the power cycle. It should be apparent that other linear positioning devices can be used in place of indexing servo motor 212 including a direct linkage to the torque plate 220.

In still another embodiment (not shown), the torque plate angle 130 may be varied using a system of six load-bearing, telescoping struts which are operatively connected between the cylinder bank 20 and the torque plate 120. The struts are positioned at an angle with respect to each other so that adjacent struts are closer to one another at one end thereof. The configuration forms a series of six nesting triangular spaces. By coordinating the extension and retraction of the telescoping struts, the torque plate axis 126 may be positioned at any angle in relationship to the central longitudinal axis 22, may be positioned at any point longitudinally along central longitudinal axis 22, and may be positioned at any point radially separated from central longitudinal axis 22. This total freedom of movement, in addition to changing the torque plate angle 130, can also change the position of top dead center, the acceleration rate, and the rate of the trajectory curve of the interaction between the pistons 30 and the cylinder bank 20. Again, the torque plate angle 130 is varied in real time in order to optimize the engine performance while operating in changing conditions of altitude, weather, RPM, fuel inconsistencies, simple throttle position, etc.

Operation of the Engine

Referring to FIGS. 1 and 2A, each combustion chamber in the cylinder bank 20 completes two full rotations in order to achieve a four-cycle operation as follows: intake (0°–180°), compression (180°–360°), power (360°–545°), and exhaust (540°–720°). It should be noted that the aforementioned and following degree ranges are approximate, and are stated as such, for purposes of clarity only. The degree ranges may be adjusted to affect the power, speed, torque, fuel economy and emission quality for each application of the engine.

With reference to Cylinder #1, the intake cycle starts with the piston 30 in the top dead center position at 0°, the torque plate 120 set at an oblique angle in relation to the cylinder bank 20, and the poppet valve 32 opened by action of the cam surface 31. As the Cylinder #1 rotates, the piston 30 in that cylinder 28 is pulled downward in relation the cylinder bank 20 by the torque plate 120 thereby enlarging the combustion chamber within the cylinder 28. The poppet valve 32 is serially modulated to open by action of the cam surface 84 on the cam plate 82, which is synchronized to the cylinder bank 20 by the meshing action of external gear 100 on cam plate 82 with internal gear 102 on cylinder bank 20 at location 104 at a ratio of seven rotations of the cam plate 82 to six rotations of the cylinder bank 20. Pressurized air from the turbine 50 passes through stationary port 180 (see FIG. 2) in the turbine shroud 68 and enters the cylinder 28 through intake port 34 at 0° of rotation through 70° of rotation so as to cool the valve 32 and so as to increasingly fill the cylinder 28 with air as the combustion chamber enlarges within the cylinder 28. The stationary port 180 in the turbine shroud 68 is separated by an area 182 from about 70° to 90° of rotation so as not to allow the fuel/air mixture from intake manifold inlet area 184 to touch the hot valve 32 before it has been cooled by the pressurized air coming from the turbine 50. Starting at 90° of rotation fuel is added to the cylinder chamber via the series of fuel lines 34, which pass longitudinally through the turbine shroud 68 to the fuel injectors 52. Each fuel injector 52 introduces an appropriate measure of atomized fuel to the stream of pressurized air as intake port 34 passes circumferentially along intake manifold inlet area 184 in the turbine shroud 68 up to a point of 180° of rotation.

The compression cycle begins at 180° of rotation at which point the intake manifold inlet 184 ends and the poppet valve 32 closes by action of the cam plate 82 and passes into intake manifold sealed area 186 thereby effectively sealing the combustion chamber within the cylinder 28 via the poppet valve 32 for the entire compression and power cycles of the engine. As the cylinder 28 moves from 180° to 360°, the piston 30 now moves circumferentially upward, in relation to the cylinder bank 20, by action of the torque plate 120, thereby compressing the air/fuel mixture to its smallest volume at about 360° of rotation.

The power cycle commences at 360° of rotation. During the power cycle the compressed air/fuel mixture in the cylinder 28 is ignited by any one of a variety of means including a spark plug, glow plug, diesel effect or other ignition promoter. As shown in FIG. 1, the spark plug is controlled to fire on every other cylinder 28 via the spark plug commutator 24 and ignition sequencer 26. The ignition of the fuel/air mixture forms a high pressure within the cylinder 28 and a buckling relationship forms between cylinder 28 and the piston 30 between 360° and 540° of rotation. This buckling relationship forces the cylinder head and piston 30 apart and thereby causing the entire cylinder bank 20, pistons 30, connecting rods 40, and torque plate 120 to rotate. The vertical downward force of the connecting rod 40 on the torque plate 120 equals the circumferential force when the torque plate 120 is at a 45° angle to central longitudinal axis 22. The radius of the circumferential path that outer ends 46 of the connecting rods 40 take as the torque plate 120 rotates about the central axis 84 multiplies this force by the length of said radius. A change in the oblique angle 130 of the torque plate 120 to the central longitudinal axis 22 will proportionally vary this value. A decrease in the angle of the torque plate 120 to the central longitudinal axis 22 will multiply the force upwards, and conversely, an increase in the oblique angle 130 will lower this value. The action of the power cycle thus causes the whole system to rotate in a positive direction. The valve 32 remains closed through both the compression and power cycles from 180° to 540° of rotation. From 360° through 540° of rotation, sealed area 188 on the stationary housing 18 is operatively engaged with exhaust port 36 via seal 190 (see FIG. 1). Seal 190 forms a second barrier to the pressures that forms within cylinder 28. This further seals the combustion gases from escaping into the atmosphere until the exhaust port 36 is aligned with the exhaust manifold opening area 192 on the stationary housing 18 and the exhaust manifold 23.

The exhaust cycle commences at 540° of rotation through 720°. The combustion exhaust is released from the cylinder 28 as the valve 32 is depressed by action of the cam surface 84. The combustion exhaust passes through exhaust port 34 and through circumferential exhaust opening 192 in the stationary housing 18, which leads to exhaust manifold 23, and then to an appropriate collection system, preferably including a muffler and catalytic converter (not shown). The exhaust opening area 192 and the exhaust manifold 23 end just prior to 720° of rotation and the four-cycle operation is complete. As the degrees of rotation turn past top dead center (720°), circumferential opening 180 again is exposed and a fresh charge of air is again introduced as described above and the valve 32 remains open for the next cycle.

The above description is made with respect to Cylinder #1 and applies respectively to Cylinders #2–190 7. FIGS. 2A–2G illustrate the precise sequence of valve 32 activation in relation to the four-cycle operation of the engine, wherein the cam plate 82 is rotating at a seven-to-six gear ratio with respect to the cylinder bank 20. FIGS. 2A–2G illustrate this relationship over one revolution or 360° wherein each combustion chamber undergoes two cycles. Since adjacent cylinders simultaneously undergo opposite cycles it is possible to discern the full four-cycle operation which occurs over two full rotations or 720° of the cylinder bank 20.

FIG. 2A illustrates the position of the cam surfaces 84 in relation to the valves 32 when Cylinder #1 is in the top dead center position (approximately 0°). In this position the valve 32 in Cylinder #1 is opened by action of Cam #1 for an intake cycle, the valve 32 in Cylinder #2 is closed for the power cycle, the valve 32 in Cylinder #3 is opened by action of Cam #2 for an intake cycle, the valve 32 in Cylinder #4 is closed for the power cycle but it is about to be opened for the exhaust cycle, the valve 32 in Cylinder #5 is closed for the compression cycle, the valve 32 in Cylinder #6 is opened by action of Cam #3 for the exhaust cycle, and the valve 32 in Cylinder #7 is closed for the compression cycle.

FIG. 2B illustrates the position of the cam surfaces 84 in relation to the valves 32 after rotation of both the cam plate 82 and the cylinder bank 20 at 1/7 of one rotation (approximately 51.4°). In this position, the valve 32 in Cylinder #1 is still opened by Cam #1 for the intake cycle, the valve 32 in Cylinder #2 is still closed for the power cycle, the valve 32 in Cylinder #3 is still opened by Cam #2 for the intake cycle, the valve 32 in Cylinder #4 is opened by Cam #2 for the exhaust cycle, the valve 32 in Cylinder #5 is still closed for the compression cycle, the valve 32 in Cylinder #6 is still opened by Cam #3 for the exhaust cycle, and the valve 32 in Cylinder #7 is closed for the power cycle.

FIG. 2C illustrates the position of the cam surfaces 84 in relation to the valves 32 after rotation of both the cam plate 82 and the cylinder bank 20 at 2/7 of one rotation (approximately 102.8°). In this position, the valve 32 in Cylinder #1 is still opened by Cam #1 for the intake cycle, the valve 32 in Cylinder #2 is still closed for the power cycle but is about to be opened by Cam #1 for the exhaust cycle, the valve 32 in Cylinder #3 is now closed for the compression cycle, the valve 32 in Cylinder #4 is opened by Cam #2 for the exhaust cycle, the valve 32 in Cylinder #5 is still closed for the compression cycle, the valve 32 in Cylinder #6 is still opened by Cam #3 for the intake cycle, and the valve 32 in Cylinder #7 is still closed for the power cycle.

FIG. 2D illustrates the position of the cam surfaces 84 in relation to the valves 32 after rotation of both the cam plate 82 and the cylinder bank 20 at 3/7 of one rotation (approximately 154.3°). In this position, the valve 32 in Cylinder #1 is still opened by Cam #1 for the intake cycle and about to be closed to start the compression cycle, the valve 32 in Cylinder #2 is opened by Cam # 1 for the exhaust cycle, the valve 32 in Cylinder #3 remains closed for the compression cycle, the valve 32 in Cylinder #4 is opened by Cam #2 for the exhaust cycle, the valve 32 in Cylinder #5 remains closed for the power cycle, the valve 32 in Cylinder #6 is still opened by Cam #3 for the intake cycle, and the valve 32 in Cylinder #7 is still closed for the power cycle.

FIG. 2E illustrates the position of the cam surfaces 84 in relation to the valves 32 after rotation of both the cam plate 82 and the cylinder bank 20 at 4/7 of one rotation (approximately 205.7°). In this position, the valve 32 in Cylinder #1 is now closed for the compression cycle, the valve 32 in Cylinder #2 is opened by Cam #1 for the exhaust cycle, the valve 32 in Cylinder #3 is closed for the compression cycle but about to start the power cycle, the valve 32 in Cylinder #4 is opened by Cam #2 for the intake cycle, the valve 32 in Cylinder #5 remains closed for the power cycle, the valve 32 in Cylinder #6 is still opened by Cam #3 for the intake cycle, and the valve 32 in Cylinder #7 is still closed for the power cycle but is about to be opened by Cam #3 to start the exhaust cycle.

FIG. 2F illustrates the position of the cam surfaces 84 in relation to the valves 32 after rotation of both the cam plate 82 and the cylinder bank 20 at 5/7 of one rotation (approximately 257.1°). In this position, the valve 32 in Cylinder #1 is closed for the compression cycle, the valve 32 in Cylinder #2 is opened by Cam #1 for the exhaust cycle, the valve 32 in Cylinder #3 is closed for the power cycle, the valve 32 in Cylinder #4 is opened by Cam #2 for the intake cycle, the valve 32 in Cylinder #5 remains closed for the power cycle, the valve 32 in Cylinder #6 is still opened by Cam #3 for the intake cycle, and the valve 32 in Cylinder #7 is still opened by Cam #3 for the exhaust cycle.

FIG. 2G illustrates the position of the cam surfaces 84 in relation to the valves 32 after rotation of both the cam plate 82 and the cylinder bank 20 at 6/7 of one rotation (approximately 308.6°). In this position, the valve 32 in Cylinder #1 is closed for the compression cycle and about to enter the power cycle, the valve 32 in Cylinder #2 remains open by Cam #1 for the intake cycle, the valve 32 in Cylinder #3 is closed for the power cycle, the valve 32 in Cylinder #4 is opened by Cam #2 for the intake cycle, the valve 32 in Cylinder #5 remains closed for the power cycle but is about to be opened by Cam #2 for the exhaust cycle, the valve 32 in Cylinder #6 is now closed for the compression cycle, and the valve 32 in Cylinder #7 remains open by Cam #3 for the exhaust cycle.

Although the present invention has been described with reference to preferred embodiments, workers skilled in the art will recognize that changes may be made in form and detail without departing from the spirit and scope of the invention. For example, slight modifications to the structure of the present invention which has been described with respect to a four cycle internal combustion engines, would permit the functioning principals of the design to be applied to a two cycle, diesel, steam or sterling cycle engines.

What is claimed is:

1. An engine block assembly comprising:

a stationary housing;

a cylinder bank rotatably mounted to the housing about a central longitudinal axis, the cylinder bank having a plurality of cylinders therein radially distanced from and parallel to the central longitudinal axis, each cylinder having a cylinder wall, an intake port, an exhaust port, a valve assembly including one valve which simultaneously opens both the intake port and the exhaust port and which simultaneously closes both the intake port and the exhaust port, a piston moveable within the cylinder between an up position and a down position, and a connecting member having an inner end connected to the piston and an outer end;

a thrust plate operatively connected to the outer ends of the connecting members, the thrust plate being rotatably mounted in a torque plane defined by the outer ends of the connecting members and which makes an oblique angle to a plane perpendicular to the central longitudinal axis, so that as the cylinder bank rotates the thrust plate sequentially guides each piston from the up position to the down position during a first portion of a rotation of the cylinder bank and then sequentially guides each piston from the down position to the up position during a second portion of the rotation of the cylinder bank; and a synchronizing member operatively connected to the cylinder bank and the thrust plate so that the cylinder bank and thrust plate rotate at the same speed.

2. The engine block assembly of claim 1, further comprising fuel supply means operatively connected to the housing and disposed with respect to the cylinder bank for supplying fuel into the plurality of cylinders in a timed sequence as the cylinder bank rotates around the central longitudinal axis.

3. The engine block assembly of claim 2, wherein the fuel supply means supplies a combustible fuel, the engine further comprising ignition means for igniting the combustible fuel in each cylinders in a timed sequence thereby forcing the respective piston therein to the down position and rotating the cylinder bank.

4. The engine block assembly of claim 3, wherein there is an odd number of cylinders equidistantly spaced apart from each other in the cylinder bank.

5. The engine block assembly of claim 4, wherein the engine is a four-cycle engine in which each cylinder undergoes an exhaust stroke, an intake stroke, a compression stroke, and a power stroke, wherein the engine includes valve assembly control means for sequentially opening the intake port of every other cylinder for the intake stroke during which the combustible fuel is sequentially supplied to said every other cylinder as each respective piston therein sequentially moves from the up position to the down position, for sequentially closing the exhaust port and the intake port of said every other cylinder for the compression stroke during which the combustible fuel in said every other cylinder is sequentially compressed as the respective piston therein sequentially moves from the down position to the up position, for maintaining the exhaust port and the intake port of said every other cylinder closed for the power stroke during which the ignition means sequentially ignites the combustible fuel in said every other cylinder sequentially forcing the respective piston therein from the up position to the down position, and for sequentially opening the exhaust port of said every other cylinder for the exhaust stroke during which combusted gases are sequentially exhausted from said every other cylinder as the respective piston therein sequentially moves from the down position to the up position, wherein one four-cycle operation is completed for each cylinder after two full rotations of the cylinder bank.

6. The engine block assembly of claim 5, wherein the valve assembly control means includes a cam assembly having a plurality of uniform, equidistantly-spaced cam surfaces thereon, each of which acts to mechanically open and close the valve in each cylinder.

7. The engine block assembly of claim 6, wherein the cam assembly is operatively connected to the cylinder bank so that the cam assembly is driven by the cylinder bank at a speed different from that of the cylinder bank, so that the valve in each cylinder is maintained in an open position for one full rotation of the cylinder bank for the exhaust and intake strokes, and so that the valve in each cylinder is maintained in a closed position for one full rotation of the cylinder bank for the compression and power strokes.

8. The engine block assembly of claim 1, further comprising torque adjustment means for moving the torque plane rotatably about an axis that is radially offset from the central longitudinal axis, thereby changing the oblique angle that the torque plane makes with the plane perpendicular to the central longitudinal axis in a range, between 0° and 90°, in order to proportionally vary the displacement ratio of the pistons and thereby control the compression ratio of the engine.

9. The engine block assembly of claim 8, wherein the synchronizing member is a shaft connected at one end to the cylinder bank along the central longitudinal axis and at the other end to the thrust plate, wherein a length of the shaft is adjustable as the oblique angle between the torque plane and the plane perpendicular to the central longitudinal axis is changed.

10. The engine block assembly of claim 1, further comprising an undulating cam surface operatively engaged with the thrust plate for moving the connecting rods and pistons up and down with respect to the torque plane while the cylinder bank rotates, so that the stroke of the piston is decreased and increased at a selected timing sequence and so that the rate of acceleration of the piston is thereby decreased, increased and kept constant at the selected timing sequence.

11. The engin block assembly of claim 1, further comprising an air compressor adapted to provide compressed air into the plurality of cylinders for combustion and onto an exterior surface of the cylinders for cooling thereof.

12. An engine block assembly comprising:

a stationary housing;

a cylinder bank rotatably mounted to the housing about a central longitudinal axis, the cylinder bank having at least one cooling slot opening to an exterior surface and having a a plurality of cylinders therein radially distanced from the central longitudinal axis, each cylinder having a cylinder wall, an intake port, an exhaust port, a valve assembly governing the opening and closing of the intake port and the exhaust port, a piston moveable within the cylinder between an up position and a down position, and a connecting member having an inner end connected to the piston and an outer end;

a thrust plate operatively connected to the outer ends of the connecting members, the thrust plate being rotatably mounted in a torque plane defined by the outer ends of the connecting members and which makes an oblique angle to a plane perpendicular to the central longitudinal axis, so that as the cylinder bank rotates the thrust plate sequentially guides each piston from the up position to the down position during a first portion of a rotation of the cylinder bank and then sequentially guides each piston from the down position to the up position during a second portion of the rotation of the cylinder bank;

a synchronizing member operatively connected to the cylinder bank and the thrust plate so that the cylinder bank and thrust plate rotate at the same speed; and an air compressor providing a first portion of compressed air into the plurality of cylinders for combustion and providing a second portion of compressed air out through said at least one coolong slot so as to cool the exterior surface of the cylinders.

13. The engine block assembly of claim 12, further comprising torque adjustment means for moving the torque plane rotatably about an axis that is radially offset from the central longitudinal axis while the cylinder bank is rotating, thereby changing the oblique angle that the torque plane makes with the plane perpendicular to the central longitudinal axis in a range between 0□ and 90□, in order to proportionally vary the displacement ratio of the pistons within the cylinders and thereby control the compression ratio of the engine.

14. The engine block assembly of claim 12, wherein the air compressor is rotatably mounted to the stationary housing for rotation around the central longitudinal axis independent of the cylinder bank.

15. The engine block assembly of claim 12, further comprising an air regulator positioned on the cylinder bank adjacent to the cooling slot for regulating the flow of the second portion of compressed air so as to increase and decrease heat dissipation.

16. The engine block assembly of claim 12, wherein the cooling slot is positioned on the cylinder bank between the central longitudinal axis and the plurality of cylinders so that the second portion of compressed air passes from an interior portion of the cylinder bank around each of the cylinders for cooling thereof.

17. A four-cycle rotating engine having an intake stroke, a compression stroke, a power stroke and an exhaust stroke, the engine comprising:

a stationary housing;

a cylinder bank rotatably mounted to the housing for rotation around a central longitudinal axis, the cylinder bank having an odd number of cylinders therein radially spaced from the central longitudinal axis, each cylinder having a cylinder wall, an intake port, an exhaust port, a valve assembly including one valve which simultaneously opens both the intake port and the exhaust port and which simultaneously closes both the intake port and the exhaust port, a piston moveable within the cylinder between an up position and a down position, and a connecting member having an inner end connected to the piston and an outer end;

a thrust plate operatively connected to the outer ends of the connecting members, the thrust plate being rotatably mounted in a torque plane defined by the outer ends of the connecting members and which makes an oblique angle to a plane perpendicular to the central longitudinal axis, so that as the cylinder bank rotates the thrust plate sequentially guides each piston from the up position to the down position during a first portion of a rotation of the cylinder bank and then sequentially guides each piston from the down position to the up position during a second portion of the rotation of the cylinder bank;

fuel supply means operatively connected to the housing and disposed with respect to the rotating cylinder bank for supplying fuel into the intake port of of every other cylinder during a first portion of a first rotation of the cylinder bank as the pistons therein sequentially move from the up position to the down position, wherein the fuel in said every other cylinder is then compressed during a second portion of the first rotation of the cylinder bank as the pistons therein sequentially move from the down position to the up position;

ignition means for igniting the compressed fuel in said every other cylinder during a first portion of a second rotation of the cylinder bank thereby sequentially moving the pistons therein from the up position to the down position and causing the cylinder bank to further rotate, wherein combusted gases therefrom are sequentially exhausted through the exhaust port of said every other cylinder during a second portion of the second rotation of the cylinder bank; and whereby one four-cycle operation of the engine is completed for all said odd number of cylinders in the course of two full rotations of the cylinder bank.

18. The engine of claim 17, further comprising a synchronizing member operatively connecting a perimeter of the cylinder bank and a perimeter of the thrust plate so that the cylinder bank and thrust plate rotate at the same speed.

19. The engine of claim 17, further comprising valve assembly control means for sequentially opening the valve in said every other cylinder for one rotation of the cylinder bank for the exhaust stroke and the intake stroke, and then for sequentially closing the valve in said every other cylinder for a subsequent rotation of the cylinder bank for the compression stroke and the power stroke.

20. The engine of claim 19, wherein the valve assembly control means includes a mechanical actuator for controlling the opening and closing the valve of each cylinder, the mechanical actuator being operatively connected to the cylinder bank so that the mechanical actuator is driven by the cylinder bank at a speed different from that of the cylinder bank.

21. The engine of claim 17, further comprising torque adjustment means for moving the torque plane rotatably about an axis that is radially offset from the central longitudinal axis while the cylinder bank is rotating, thereby changing the oblique angle that the torque plane makes with the plane perpendicular to the central longitudinal axis in a range between 0□ and 90□, in order to proportionally vary the displacement ratio of the pistons within the cylinders and thereby control the compression ratio of the engine.

22. The engine of claim 21, wherein the torque adjustment means is operatively related to the fuel supply means so that the more fuel that is supplied the greater the oblique angle and so that the less fuel that is supplied the lesser the oblique angle.

23. The engine of claim 17, further comprising an air compressor adapted to provide compressed air into the plurality of cylinders for combustion and onto an exterior surface of the cylinders for cooling thereof.

24. A four-cycle rotating engine having an intake stroke, a compression stroke, a power stroke and an exhaust stroke, the engine comprising:

a stationary housing;

a cylinder bank rotatably mounted to the housing for rotation around a central longitudinal axis, the cylinder bank having an odd number of cylinders therein radially spaced from and substantially parallel to the central longitudinal axis, each cylinder having a cylinder wall, an intake port, an exhaust port, a valve assembly governing the opening and closing of the intake port and the exhaust port, a piston moveable within the cylinder between an up position and a down position, and a connecting member having an inner end connected to the piston and an outer end, the cylinder bank further having a cooling port;

an air compressor providing a first portion of compressed air into the plurality of cylinders for combustion and providing a second portion of compressed air through the cooling port for cooling an exterior surface of the cylinders; a thrust plate operatively connected to the outer ends of the connecting members, the thrust plate being rotatably mounted in a torque plane defined by the outer ends of the connecting members and which makes an oblique angle to a plane perpendicular to the central longitudinal axis, so that as the cylinder bank rotates the thrust plate sequentially guides each piston from the up position to the down position during a first portion of a rotation of the cylinder bank and then sequentially guides each piston from the down position to the up position during a second portion of the rotation of the cylinder bank;

fuel supply means operatively connected to the housing and disposed with respect to the rotating cylinder bank for supplying fuel into the intake port of every other cylinder during a first portion of a first rotation of the cylinder bank as the pistons therein sequentially move from the up position to the down position, wherein the fuel in said every other cylinder is then compressed during a second portion of the first rotation of the cylinder bank as the pistons therein sequentially move from the down position to the up position; and ignition means for igniting the compressed fuel in said every other cylinder during a first portion of a second rotation of the cylinder bank thereby sequentially moving the pistons therein from the up position to the down position and causing the cylinder bank to further rotate, wherein combusted gases therefrom are sequentially exhausted through the exhaust port of said every other cylinder during a second portion of the second rotation of the cylinder bank;

whereby one four-cycle operation of the engine is completed for all said odd number of cylinders in the course of two full rotations of the cylinder bank.

25. The engine of claim 24, further comprising torque adjustment means for moving the torque plane rotatably about an axis that is radially offset from the central longitudinal axis while the cylinder bank is rotating, thereby changing the oblique angle that the torque plane makes with the plane perpendicular to the central longitudinal axis in a range between 0□ and 90□, in order to proportionally vary the displacement ratio of the pistons within the cylinders and thereby control the compression ratio of the engine.

26. The engine of claim 24, wherein the stationary housing includes an intake opening operatively disposed with respect to the air turbine and the intake port of each cylinder so that fuel and air supplied thereto enters the intake port only during the first portion of a rotation and only when the valve is open, and wherein the stationary housing further includes an exhaust opening operatively disposed with respect to the exhaust port of each cylinder so that combusted gases exit the exhaust port only during the second portion of a rotation and only when the valve is open.

27. The engine of claim 24, wherein the air compressor is rotatably mounted to the stationary housing for rotation around the central longitudinal axis independent of the cylinder bank.

28. The engine of claim 24, further comprising an air regulator positioned on the cylinder bank adjacent to the cooling slot for regulating the flow of the second portion of compressed air so as to increase and decrease heat dissipation.

29. The engine of claim 24, wherein the cooling slot is positioned on the cylinder bank between the central longitudinal axis and the plurality of cylinders so that the second portion of compressed air passes from an interior portion of the cylinder bank around each of the cylinders for cooling thereof.

30. An engine block assembly comprising:

a stationary housing;

a cylinder bank rotatably mounted to the housing about a central longitudinal axis, the cylinder bank having a plurality of cylinders therein equidistantly, circumferentially spaced about and radially distanced from the central longitudinal axis, each cylinder having a cylinder wall, and intake port, an exhaust port, a valve assembly governing the opening and closing of the intake port and the exhaust port, a piston moveable within the cylinder between an up position and a down position, and a connecting member having an inner end connecting to the piston and an outer end;

a thrust plate operatively connected to the outer ends of the connecting members, the thrust plate being rotatably mounted in a torque plane defined by the outer ends of the connecting members and which makes an oblique angle to a plane perpendicular to the central longitudinal axis so that as the cylinder bank rotates the thrust plate sequentially guides each piston from the up position to the down position during a first portion of a rotation of the cylinder bank and then sequentially guides each piston from the down position to the up position during a second potion of the rotation of the cylinder bank;

a synchronizing member operatively connected to the cylinder bank and the thrust bank so that the cylinder bank and thrust plate rotate at the same speed; and an undulating cam surface operatively engaged with the thrust plate for moving the connecting rods and pistons up and down with respect to the torque plane while the cylinder bank rotates, so that the stroke of the piston is decreased and increased at a selected timing sequence and so that the rate of accerleration of the piston is therby decreased and kept constant at a selected timing sequence.

31. The engine block assembly of claim 30, further comprising an air compressor rotatably mounted to the stationary housing for rotation around the central longitudinal axis independent of the cylinder bank for supplying compressed air into the plurality of cylinders for combustion.

32. The engine block assembly of claim 31, wherein the air compressor further supplies compressed air to an exterior surface of the cylinders for cooling therof.

33. The engine block assembly of claim 30, further comprising fuel supply means operatively connected to the stationary housing and disposed with respect to the cylinder bank for supplying a combustible fuel into the plurality of cylinders in a timed sequence as the cylinder bank rotates around the central longitudinal axis; ignition means for igniting the combustible fuel in each cylinder in a timed sequence as the cylinder bank rotates around the central longitudinal axis, and wherein the engine is a four-cycle engine in which each cylinder undergoes an exhaust stroke, an intake stroke, a compression stroke, and a power stroke, wherein the intake port of every other cylinder is opened for the intake stroke during which the combustible fuel is sequentially supplied to said every other cylinder as each respective piston therein sequentially moves moves from the up position to the down position, for sequentially closing the exhaust port and the intake port of every other cylinder for the compression stroke during which the combustible fuel in said every other cylinder is sequentially compressed as the respective piston therein sequentially moves from the down position to the up position, for maintaining the exhaust port and the intake port of said every other cylinder closed for the power stroke during which the ignition means sequentially ignites the combustible fuel in said every other cylinder sequentially forcing the respective piston therein from the up position to the down position, and for sequentially opening the exhaust port of said every other cylinder for the exhaust stroke during which combusted gases are sequentially exhausted from said every other cylinder as the respective piston therein sequentially moves from the down position to the up position, wherein one four-cycle operation is completed for each cylinder after two full rotations of the cylinder bank.

34. An engine block assembly comprising:

a stationary housing;

a cylinder bank rotatably mounted to the housing about a central longitudinal axis, the cylinder bank having a plurality of cylinders therein equidistantly, circumferentially spaced about and radially distanced from the central longitudinal axis, each cylinder having a cylinder wall, an intake port, an exhaust port, valve assembly governing the opening and closing of the intake port and the exhaust port, a piston moveable within the cylinder between an up position and a down position, and a connecting member having an inner end connected to the piston and an outer end;

a cam assembly rotatably mounted to the housing about an axis parallel to the central longitudinal axis, the cam assembly having a plurality of uniform, equidistantly circumferentially spaced about said axis, cam surfaces thereon, wherein each of said cam surfaces actuates each valve assembly;

thrust plate operatively connected to the outer ends of the connecting members, the thrust plate being rotatably mounted in a torque plane defined by the outer ends of the connecting members and which makes an oblique angle to a plane perpendicular to the central longitudinal axis, so that as the cylinder bank rotates the thrust plate sequentially guides each piston from the up position to the down position during a first portion of a rotation of the cylinder bank and then sequentially guides each piston from the down position to the up position during a second portion of the rotation of the cylinder bank; and a synchronizing member operatively connected to the cylinder bank and the thrust plate so that the cylinder bank and thrust plate rotate at the same speed.

35. The engine block assembly of claim 34, further comprising fuel supply means operatively connected to the stationary housing and disposed with respect to the cylinder bank for supplying a combustible fuel into the plurality of cylinders in a timed sequence as the cylinder bank rotates around the central longitudinal axis; ignition means for igniting the combustible fuel in each cylinder in a timed sequence as the cylinder bank rotates around the central longitudinal axis, and wherein the engine is a four-cycle engin in which each cylinder undergoes an exhaust stroke, an intake stroke, a compression stroke, and a power stroke, wherein the intake port of every other cylinder is opened for the intake stroke during which the combustible fuel is sequentially supplied to said every other cylinder as each respective piston therein sequentially moves from the up position to the down position, for sequentially closing the exhaust port and the intake port of said every other cylinder for the compression stroke during which the combustible fuel in said every other cylinder is sequentially compressed as the respective piston therein sequentially moves from the down position to the up position, for maintaining the exhaust port and the intake port of said every other cylinder closed for the power stroke during which the ignition means sequentially igniotes the combustible fuel in said every other cylinder sequentially forciong the respective piston therein from the up position to the down position, and for sequentially opening the exhaust port of said every other cylinder for the exhaust stroke during which combusted gases are sequentially exhausted from said every other cylinder as the respective piston therein sequentially moves from the down position to the up position, wherein one four-cycle operation is completed for each cylinder after two full rotations of the cylinder bank.

36. The engine block assembly of claim 35, further comprising an air compressor into the plurality of cylinders for combustion and onto an exterior surface of the cylinders for cooling thereof.

37. The engine block assembly of claim 34, wherein the cam assembly is operatively connected to the cylinder bank so that the cam assembly is driven by the cylinder bank at a speed different from that of the cylinder bank, so that the valve in each cylinder is maintained in an open position for one full rotation of the cylinder bank for the exhaust and intake strokes, and so that the valve in each cylinder is maintained in a closed position for one full rotation of the cylinder bank for the compression and power strokes.

38. An engine block assembly comprising:

a stationary housing;

a cylinder bank rotatably mounted to the housing about a central longitudinal axis, the cylinder bank having a plurality of cylinders therein equidistantly, circumferentially spaced about and radilly distanced from the central longitudinal axis, each cylinder having a cylinder wall, an intake port, an exhaust port, a valve assembly governing the opening and closing of the intake port and the exhaust port, a piston moveable within the cylinder between an up position and a down position, and a connecting member having an inner end connecting to the piston and an outer end;

a thrust plate operatively connected to the outer ends of the connecting members, the thrust plate being rotatably mounted in a torque plane defined by the outer ends of the connecting members and which makes an oblique angle to a plane perpendicular to the central longitudinal axis, so that as the cylinder bank rotates the thrust plate sequentially guides each piston from the up position to the down position during a first portion of a rotation of the cylinder bank and then sequentially guides each piston from the down position to the up position during a second portion of the rotation of the cylinder bank;

a synchronizing member operatively connected to the cylinder bank and the thrust plate so that the cylinder bank and thrust plate rotate at the same speed; and torque adjustment means for moving the torque plane rotatably about an axis that is radially offset from the central longitudinal axis, thereby changing the oblique angle that the torque plane makes with the plane perpendicular to the central longitudinal axis in a range between 0° and 90°, in order to proportionally vary the displacement ratio of the pistons and thereby control the compression ratio of the engine.

39. The engine block assembly of claim 38, further comprising fuel supply means operatively connected to the stationary housing and disposed with the respect to the cylinder bank for supplying a combustible fuel into the the plurality of cylinders in a timed sequence as the cylinder bank rotates around the central longitudinal axis; ignition means for igniting the combustible fuel in each cylinder in a timed sequence as the cylinder bank rotates around the central longitudinal axis, and wherein the engine is a four-cycle engine in which each cylinder undergoes an exhaust stroke, an intake stroke, a compression stroke, and a power stroke, wherein the intake port of every other cylinder is opened for the intake stroke during which the combustible fuel is sequentially supplied to said every other cylinder as each respective piston therein sequentially moves from the up position to the down position, for sequentially closing the exhaust port and the intake port of said every other cylinder for the compression stroke during which the combustible fuel in said every other cylinder is sequentially compressed as the respective piston therein sequentially moves from the down position to the up position, for maintaining the exhaust port and the intake port of said every other cylinder closed for the power stroke during which the ignition means sequentially ignites the combustible fuel in said every other cylinder sequentially forcing the respective piston therein from the up position to the down position, and for sequentially opening the exhaust port of said every other cylinder for the exhaust stroke during which combusted gases are sequentially exhausted from said every other cylinder as the respective piston therein sequentially moves from the down position to the up position, wherein one four-cycle operation is completed for each cylinder after two full rotations of the cylinder bank.

40. The engine block assembly of claim 39, wherein the torque adjustment means is operatively related to the fuel supply means so that the more fuel that is supplied the greater the oblique angle and so that the less fuel that is supplied the lesser the oblique angle.

* * * * *